US008044886B2

(12) United States Patent
Choi et al.

(10) Patent No.: US 8,044,886 B2
(45) Date of Patent: Oct. 25, 2011

(54) METHOD OF DRIVING PLASMA DISPLAY PANEL AND PLASMA DISPLAY APPARATUS THEREOF

(75) Inventors: Yoon Chang Choi, Gumi-si (KR); Dong Soo Lee, Gumi-si (KR); Byoung Gun Kim, Gumi-si (KR); Seong Ho Kang, Gumi-si (KR); Kyung Ryeol Shim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 12/100,900

(22) Filed: Apr. 10, 2008

(65) Prior Publication Data

US 2009/0115702 A1 May 7, 2009

(30) Foreign Application Priority Data

Nov. 1, 2007 (KR) ..... 10-2007-0111023

(51) Int. Cl.
*G09G 3/28* (2006.01)

(52) U.S. Cl. ..... 345/60; 345/67; 315/169.4

(58) Field of Classification Search ..... 345/60–68; 315/169.1–169.4

See application file for complete search history.

(56) References Cited

U.S. PATENT DOCUMENTS

2003/0222835 A1* 12/2003 Yoon et al. ..... 345/60
2006/0001600 A1* 1/2006 Ito ..... 345/60
2006/0232507 A1* 10/2006 Myoung et al. ..... 345/60
2007/0046585 A1* 3/2007 Choi ..... 345/68
2007/0057869 A1* 3/2007 Choi ..... 345/60
2007/0241994 A1* 10/2007 Ogawa et al. ..... 345/60

FOREIGN PATENT DOCUMENTS

KR 10-2005-0110945 A 11/2005
KR 10-2006-007688 A 1/2006
KR 10-2006-0067277 A 6/2006
KR 10-2007-0088320 A 8/2007

OTHER PUBLICATIONS

Korean Office Action dated Jan. 28, 2009.

* cited by examiner

*Primary Examiner* — Amare Mengistu
*Assistant Examiner* — Hong Zhou
(74) *Attorney, Agent, or Firm* — Ked & Associates LLP

(57) ABSTRACT

The present invention relates to a plasma display apparatus and, more particularly, to a method of driving a plasma display panel. The plasma display apparatus includes a plasma display panel including a plurality of scan electrodes and sustain electrodes formed on an upper substrate, and a plurality of address electrodes formed on a lower substrate, and a driver for supplying driving signals to the plurality of electrodes. The plurality of scan electrodes are divided into first and second groups and then supplied with scan signals, and scan bias voltages supplied to the first and second groups in at least any one period of an address period are different from each other. In at least one of a plurality of subfields constituting one frame, a width of a first sustain signal of a plurality of sustain signals supplied during a sustain period is larger than a width of each of the remaining sustain signals.

18 Claims, 21 Drawing Sheets

METHOD OF DRIVING PLASMA DISPLAY PANEL AND PLASMA DISPLAY APPARATUS THEREOF

This Nonprovisional application claims priority under 35 U.S.C. §119(a) on Patent Application No. 10-2007-0111023 filed in Korea on Nov. 1, 2007, the entire contents of which are hereby incorporated by reference.

BACKGROUND OF THE INVENTION

1. Field of the Invention

The present invention relates to a plasma display apparatus and, more particularly, to a method of driving a plasma display panel.

2. Discussion of Related Art

A plasma display apparatus includes a panel in which a plurality of discharge cells are formed between a lower substrate having barrier ribs formed thereon and an upper substrate opposite to the lower substrate. The plasma display apparatus is configured to display an image in such a manner that the plurality of discharge cells are selectively discharged in response to an input image signal and a fluorescent material is excited with vacuum ultraviolet rays generated by the discharge.

For an effective display of an image, the plasma display apparatus generally includes a driving control device, which processes input image signals and outputs the processed signals to a driver for supplying driving signals to a plurality of electrodes included in a panel.

In the case of a large-screen plasma display apparatus, time margin for panel driving falls short and therefore it is necessary to drive the panel at high speed.

SUMMARY OF THE INVENTION

A plasma display apparatus according to an aspect of the present invention includes a plasma display panel including a plurality of scan electrodes and sustain electrodes formed on an upper substrate, and a plurality of address electrodes formed on a lower substrate, and a driver for supplying driving signals to the plurality of electrodes. The plurality of scan electrodes may be divided into first and second groups and then supplied with scan signals, and scan bias voltages supplied to the first and second groups in at least any one period of an address period are different from each other. In at least one of a plurality of subfields constituting one frame, a width of a first sustain signal of a plurality of sustain signals supplied during a sustain period may be larger than a width of each of the remaining sustain signals.

According to another aspect of the present invention, there is provided a method of driving a plasma display panel comprising a plurality of scan electrodes and sustain electrodes formed on an upper substrate and a plurality of address electrodes formed on a lower substrate. The method includes the step of dividing the plurality of scan electrodes into first and second groups. An address period includes first and second group scan periods in which scan signals may be supplied to the first and second groups. In the first group scan period, a scan bias voltage supplied to the second group may be higher than a scan bias voltage supplied to the first group supplied. In at least one of a plurality of subfields constituting one frame, a width of a first sustain signal of a plurality of sustain signals supplied during a sustain period may be larger than a width of each of the remaining sustain signals.

DETAILED DESCRIPTION OF THE INVENTION

A method of driving a plasma display panel and a plasma display apparatus employing the same according to the present invention will now be described in detail in connection with specific embodiments with reference to the accompanying drawings.

Figure 1:
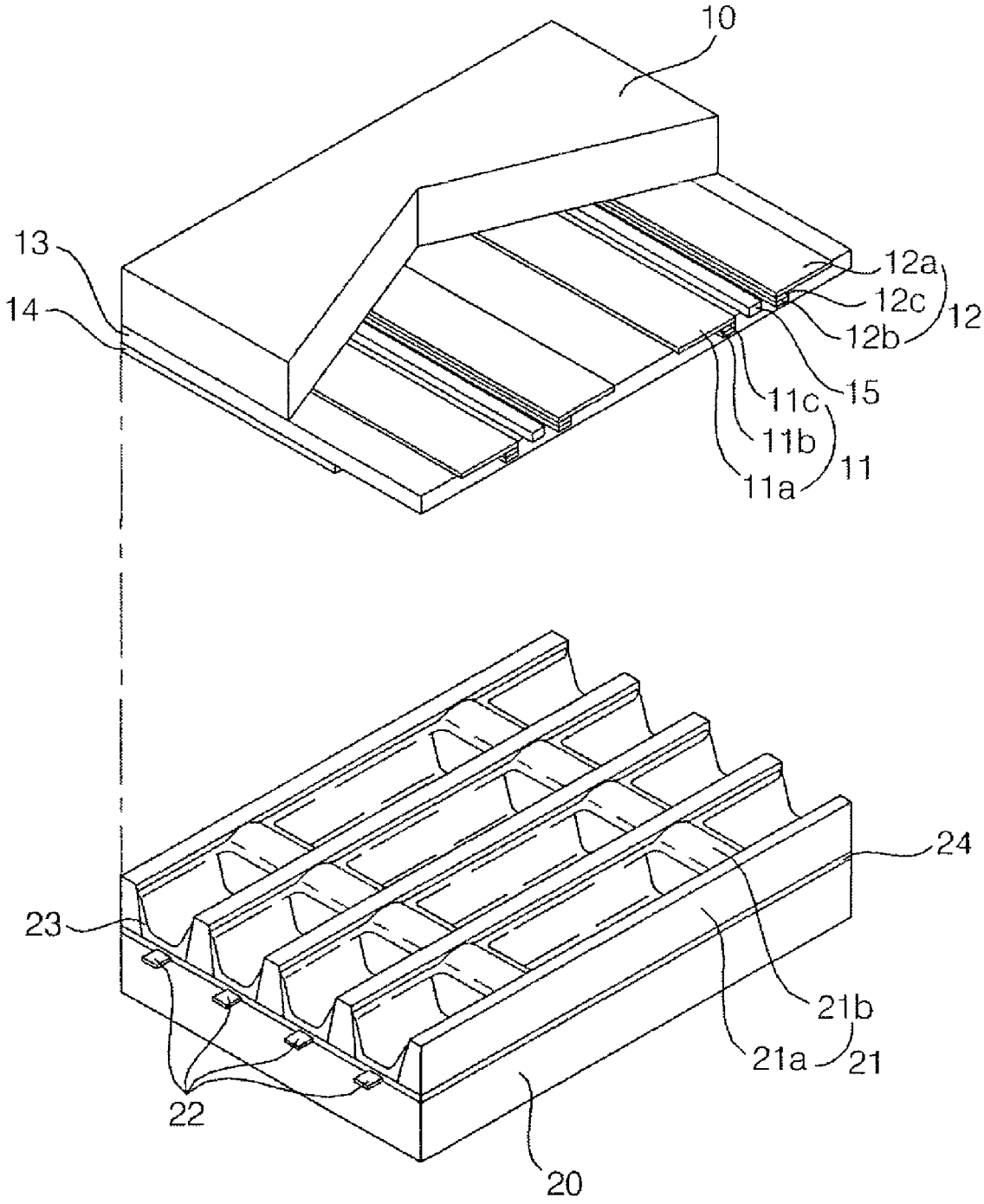
FIG. 1 is a perspective view illustrating an embodiment of the structure of a plasma display panel.

FIG. 1 is a perspective view illustrating an embodiment of the structure of a plasma display panel.

Referring to FIG. 1, the plasma display panel includes a scan electrode 11 and a sustain electrode 12 (that is, a sustain electrode pair), which are formed over an upper substrate 10, and address electrodes 22 formed over a lower substrate 20.

The sustain electrode pair 11 and 12 includes transparent electrodes 11*a* and 12*a* generally formed from indium-tin-oxide (ITO), and bus electrodes 11*b* and 12*b*. The bus electrodes 11*b* and 12*b* may be formed from metal, such as silver (Ag) or chrome (Cr), a stack type of Cr/copper (Cu)/Cr or Cr/aluminum (Al)/Cr. The bus electrodes 11*b* and 12*b* are formed on the transparent electrodes 11*a* and 12*a*, and function to decrease a voltage drop caused by the transparent electrodes 11*a* and 12*a* with a high resistance.

In accordance with an embodiment of the present invention, the sustain electrode pair 11 and 12 may have a stack structure of the transparent electrodes 11*a* and 12*a* and the bus electrodes 11*b* and 12*b*, but also include only the bus electrodes 11*b* and 12*b* without the transparent electrodes 11*a* and 12*a*. This structure is advantageous in that it can save the manufacturing cost of the plasma display panel because the transparent electrodes 11*a* and 12*a* are not used. The bus electrodes 11*b* and 12*b* used in the structure may also be formed using a variety of materials, such as a photosensitive material, other than the above-listed materials.

Black matrices 15 are arranged between the transparent electrodes 11*a* and 12*a* and the bus electrodes 11*b* and 12*b* of the scan electrode 11 and the sustain electrode 12. The black matrix 15 has a light-shielding function of absorbing external light generated outside the upper substrate 10 and decreasing reflection of the light and a function of improving the purity and contrast of the upper substrate 10.

The black matrices 15 in accordance with an embodiment of the present invention are formed over the upper substrate 10. Each black matrix 15 may include a first black matrix 15 formed at a location where it is overlapped with a barrier rib 21, and second black matrices 11*c* and 12*c* formed between the transparent electrodes 11*a* and 12*a* and the bus electrodes 11*b* and 12*b*. The first black matrix 15, and the second black matrices 11*c* and 12*c*, which are also referred to as black layers or black electrode layers, may be formed at the same time and, therefore, may be connected physically. Alternatively, they may not be formed at the same time and, therefore, may not be connected physically.

In the event that the first black matrix 15 and the second black matrices 11*c* and 12*c* are connected to each other physically, the first black matrix 15 and the second black matrices 11*c* and 12*c* are formed using the same material. However, in the event that the first black matrix 15 and the second black matrices 11*c* and 12*c* are physically separated from each other, they may be formed using different materials.

An upper dielectric layer 13 and a protection layer 14 are laminated over the upper substrate 10 in which the scan electrodes 11 and the sustain electrodes 12 are formed in parallel. Charged particles generated by discharge are accumulated on the upper dielectric layer 13. The upper dielectric layer 13 and the protection layer 14 may function to protect the sustain electrode pair 11 and 12. The protection layer 14 functions to protect the upper dielectric layer 13 from sputtering of charged particles generated at the time of gas discharge and also increase emission efficiency of secondary electrons.

The address electrodes 22 cross the scan electrodes 11 and the sustain electrodes 12. A lower dielectric layer 24 and the barrier ribs 21 are formed over a lower substrate 20 over which the address electrodes 22 are formed.

Phosphor layers 23 are formed on the surfaces of the lower dielectric layer 24 and the barrier ribs 21. Each barrier rib 21 has a longitudinal barrier rib 21*a* and a traverse barrier rib 21*b* formed in a closed type. The barrier rib 21 functions to partition discharge cells physically and prevent ultraviolet rays, which are generated by discharge, and a visible ray from leaking to neighboring discharge cells.

The embodiment of the present invention may also be applied to not only the structure of the barrier ribs 21 shown in FIG. 1, but also various forms of structures of the barrier ribs 21. For example, the present embodiment may be applied to a differential type barrier rib structure in which the longitudinal barrier rib 21*a* and the traverse barrier rib 21*b* have different heights, a channel type barrier rib structure in which a channel, which can be used as an exhaust passage, is formed in at least one of the longitudinal barrier rib 21*a* and the traverse barrier rib 21*b*, a hollow type barrier rib structure in which a hollow is formed in at least one of the longitudinal barrier rib 21*a* and the traverse barrier rib 21*b*, and so on.

In the differential type barrier rib structure, the traverse barrier rib 21*b* may preferably have a higher height than the longitudinal barrier rib 21*a*. In the channel type barrier rib structure or the hollow type barrier rib structure, a channel or hollow may be preferably formed in the traverse barrier rib 21*b*.

Meanwhile, in the present embodiment, it has been described and shown that the red (R), green (G), and blue (B) discharge cells are arranged on the same line. However, they may be arranged in different forms. For example, the R, G, and B discharge cells may also have a delta type arrangement of a triangle. Alternatively, the discharge cells may be arranged in various forms, such as square, pentagon and hexagon.

Furthermore, the fluorescent layer 23 is excited with ultraviolet rays generated during the discharge of a gas, thus generating a visible ray of one of R, G, and B. Discharge spaces between the upper/lower substrates 10 and 20 and the barrier ribs 21 are injected with an inert mixed gas for discharge, such as He+Xe, Ne+Xe or He+Ne+Xe.

Figure 2:
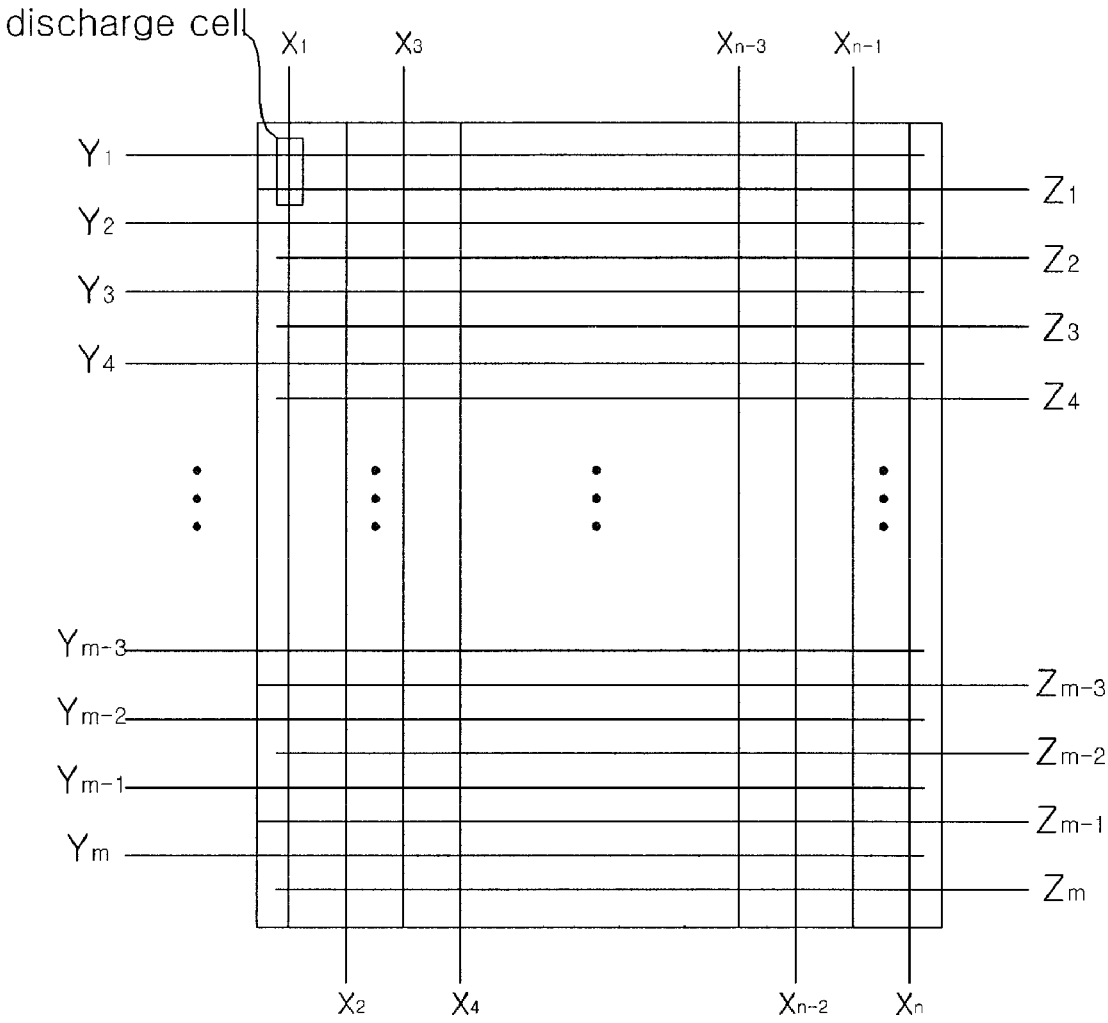
FIG. 2 is a sectional view illustrating an embodiment of the electrode arrangements of the plasma display panel.

FIG. 2 is a view illustrating an embodiment of electrode arrangements of the plasma display panel. It is preferred that a plurality of discharge cells constituting the plasma display panel be arranged in a matrix form as illustrated in FIG. 2. The plurality of discharge cells are disposed at the intersections of scan electrode lines Y1 to Ym, sustain electrodes lines Z1 to Zm, and address electrodes lines X1 to Xn, respectively. The scan electrode lines Y1 to Ym may be driven sequentially or at the same time. The sustain electrode lines Z1 to Zm may be driven at the same time. The address electrode lines X1 to Xn may be driven with them being divided into even-numbered lines and odd-numbered lines, or driven sequentially.

The electrode arrangements shown in FIG. 2 are only an embodiment of electrode arrangements of the plasma display panel according to the present invention. Therefore, the present invention is not limited to the electrode arrangements and the driving method of the plasma display panel shown in FIG. 2. For example, the present invention may also be applied to a dual scan method of driving two of the scan electrode lines Y1 to Ym at the same time. Alternatively, the address electrode lines X1 to Xn may be driven with them being divided into upper and lower parts on the basis of the center of the plasma display panel.

Figure 3:
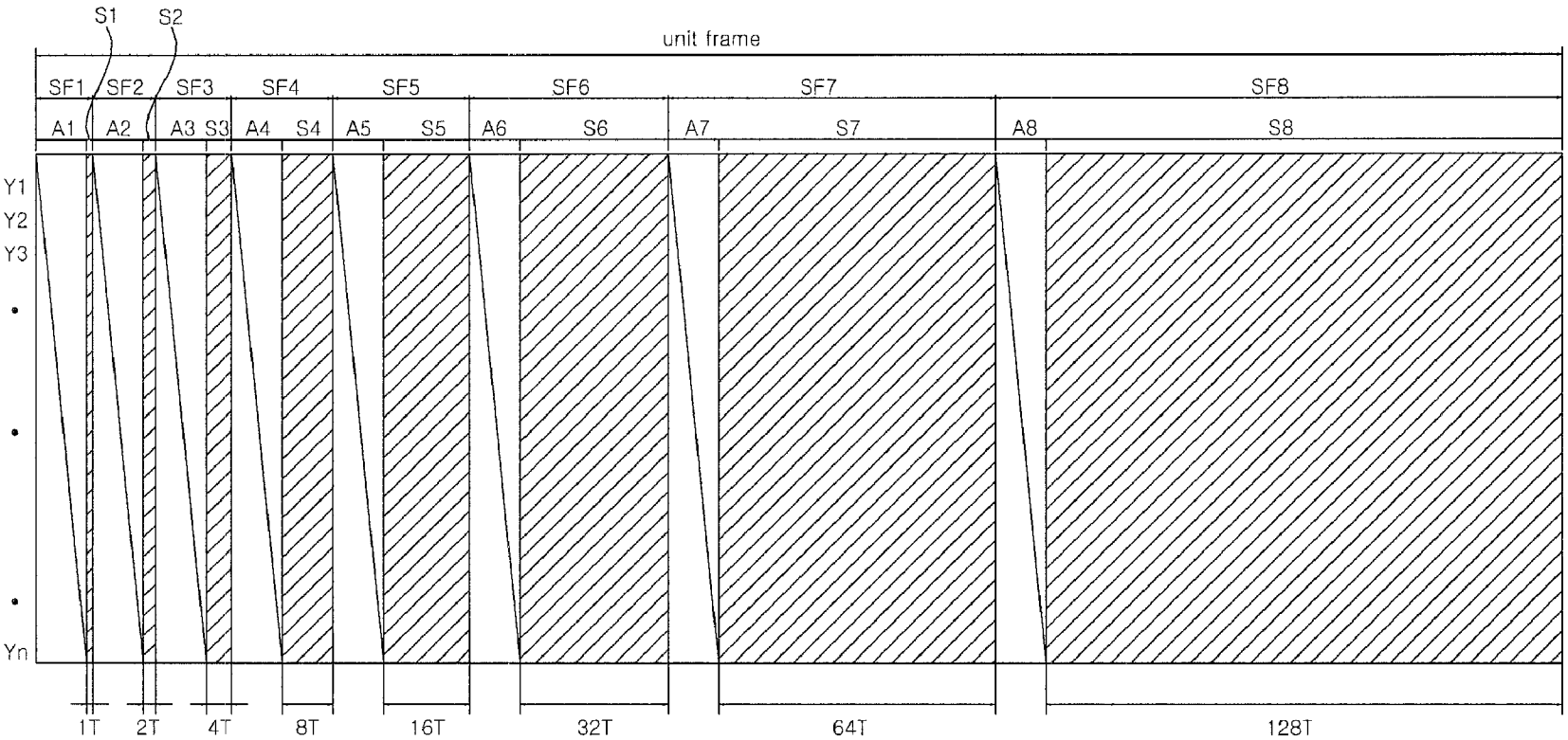
FIG. 3 is a timing diagram illustrating an embodiment of a method of time-dividing and driving the plasma display panel by dividing one frame into a plurality of subfields.

FIG. 3 is a timing diagram illustrating an embodiment of a method of time-dividing and driving the plasma display panel by dividing one frame into a plurality of subfields. A unit frame may be divided into a predetermined number (for example, eight subfields SF1, . . . , SF8) in order to realize a time-divided gray level display. Each of the subfields SF1, . . . , SF8 is divided into a reset period (not shown), address periods A1, . . . , A8, and sustain periods S1, . . . , S8.

In accordance with an embodiment of the present invention, the reset period may be omitted in at least one of the plurality of subfields. For example, the reset period may exist only in the first subfield, or exist only in a subfield approximately between the first subfield and the entire subfields.

In each of the address periods A1, . . . , A8, a display data signal is applied to the address electrode X, and scan signals corresponding to the scan electrodes Y are sequentially applied to the address electrode X.

In each of the sustain periods S1, . . . , S8, a sustain pulse is alternately applied to the scan electrodes Y and the sustain electrodes Z. Accordingly, sustain discharge is generated in discharge cells on which wall charges are formed in the address periods A1, . . . , A8.

The luminance of the plasma display panel is proportional to the number of sustain discharge pulses within the sustain periods S1, . . . , S8, which is occupied in a unit frame. In the event that one frame to form 1 image is represented by eight subfields and 256 gray levels, different numbers of sustain pulses may be sequentially allocated to the respective subfields at a ratio of 1, 2, 4, 8, 16, 32, 64, and 128. For example, in order to obtain the luminance of 133 gray levels, sustain discharge can be generated by addressing the cells during the subfield1 period, the subfield3 period, and the subfield8 period.

The number of sustain discharges allocated to each subfield may be varied depending on the weight of a subfield according to an Automatic Power Control (APC) step. In other words, although an example in which one frame is divided into eight subfields has been described with reference to FIG. 3, the present invention is not limited to the above example, but the number of subfields to form one frame may be changed in various ways depending on design specifications. For example, the plasma display panel may be driven by dividing one frame into eight or more subfields, such as 12 or 16 subfields.

Further, the number of sustain discharges allocated to each subfield may be changed in various ways in consideration of gamma characteristics or panel characteristics. For example, the degree of gray levels allocated to the subfield4 may be lowered from 8 to 6, and the degree of gray levels allocated to the subfield6 may be raised from 32 to 34.

Figure 4:
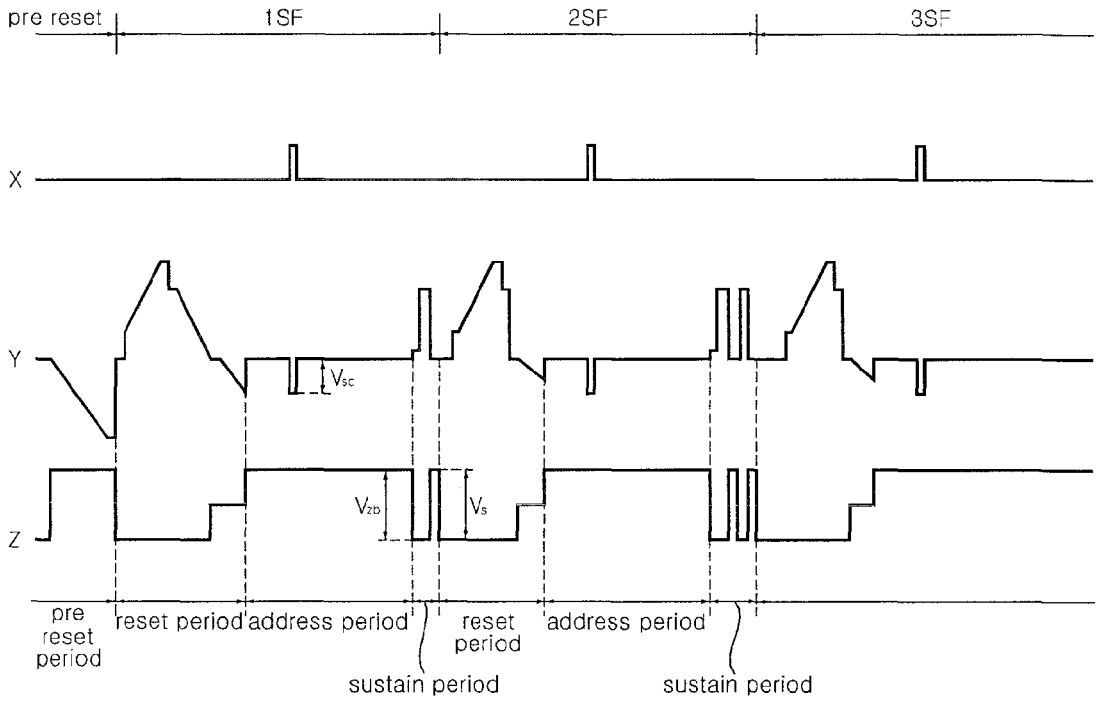
FIG. 4 is a timing diagram illustrating an embodiment of driving signals for driving the plasma display panel.

FIG. 4 is a timing diagram illustrating an embodiment of driving signals for driving the plasma display panel with respect to the one divided subfield.

Each subfield includes a pre-reset period where positive wall charges are formed on the scan electrodes Y and negative wall charges are formed on the sustain electrodes Z, a reset period where discharge cells of the entire screen are reset using wall charge distributions formed in the pre-reset period, an address period where discharge cells are selected, and a sustain period where the discharge of selected discharge cells is sustained.

The reset period includes a set-up period and a set-down period. In the set-up period, a ramp-up waveform is applied to the entire scan electrodes at the same time, so that a minute discharge occurs in the entire discharge cells and wall charges are generated accordingly. In the set-down period, a ramp-down waveform, which falls from a positive voltage lower than a peak voltage of the ramp-up waveform, is applied to the entire scan electrodes Y at the same time, so erase discharge is generated in the entire discharge cells. Accordingly, unnecessary charges are erased from the wall charges generated by the set-up discharge and spatial charges.

In the address period, a scan signal having a scan voltage Vsc of a negative polarity is sequentially applied to the scan electrodes Y and at the same time, a data signal of a positive polarity is applied to the address electrodes X. Address discharge is generated by a voltage difference between the scan signal and the data signal and a wall voltage generated during the reset period, so the cells are selected. Meanwhile, in order to enhance the efficiency of the address discharge, a sustain bias voltage Vzb is applied to the sustain electrode during the address period.

During the address period, the plurality of scan electrodes Y may be divided into two or more groups and sequentially supplied with the scan signal on a group basis. Each of the divided groups may be divided into two or more subgroups and sequentially supplied with the scan signal on a subgroup basis. For example, the plurality of scan electrodes Y may be divided into a first group and a second group. For example, the scan signal may be sequentially supplied to scan electrodes belong to the first group, and then sequentially supplied to scan electrodes belong to the second group.

In an embodiment of the present invention, the plurality of scan electrodes Y may be divided into a first group placed at the even number and a second group placed at the odd number depending upon a position formed on the panel. In another embodiment, the plurality of scan electrodes Y may be divided into a first group disposed on an upper side and a second group disposed on a lower side on the basis of the center of the panel.

The scan electrodes belonging to the first group divided according to the above method may be divided into a first subgroup placed at the even number and a second subgroup placed at the odd number, or a first subgroup disposed on an upper side and a second subgroup disposed on a lower side on the basis of the center of the first group.

In the sustain period, a sustain pulse having a sustain voltage Vs is alternately applied to the scan electrode and the sustain electrode, so sustain discharge is generated between the scan electrode and the sustain electrode in a surface discharge form.

A width of a first sustain signal or the last sustain signal of a plurality of sustain signals, which are alternately applied to the scan electrode and the sustain electrode during the sustain period, may be larger than that of the remaining sustain pulses.

After the sustain discharge is generated, an erase period in which wall charges remaining in the scan electrodes or the sustain electrodes of an on-cell selected in the address period are erased by generating weak discharge may be further included posterior to the sustain period.

The erase period may be included in all the plurality of subfields or some of the plurality of subfields. In this erase period, an erase signal for the weak discharge may be applied to electrodes to which the last sustain pulse was not applied in the sustain period.

The erase signal may include a ramp type signal that gradually rises, a low-voltage wide, a high-voltage narrow pulse, an exponential signal, a half-sinusoidal pulse or the like.

In addition, in order to generate the weak discharge, a plurality of pulses may be sequentially applied to the scan electrodes or the sustain electrodes.

The driving waveforms shown in FIG. 4 illustrate embodiments of signals for driving the plasma display panel according to the present invention. However, it is to be noted that the present invention is not limited to the waveforms shown in FIG. 4. For instance, the pre-reset period may be omitted, the polarity and voltage level of the driving signals shown in FIG. 4 may be changed, if appropriate, and the erase signal for erasing wall charges may be applied to the sustain electrode after the sustain discharge is completed. Alternatively, a single sustain driving method in which the sustain signal is applied to either the scan electrode Y or the sustain electrode Z, thus generating sustain discharge is also possible.

Figure 5:
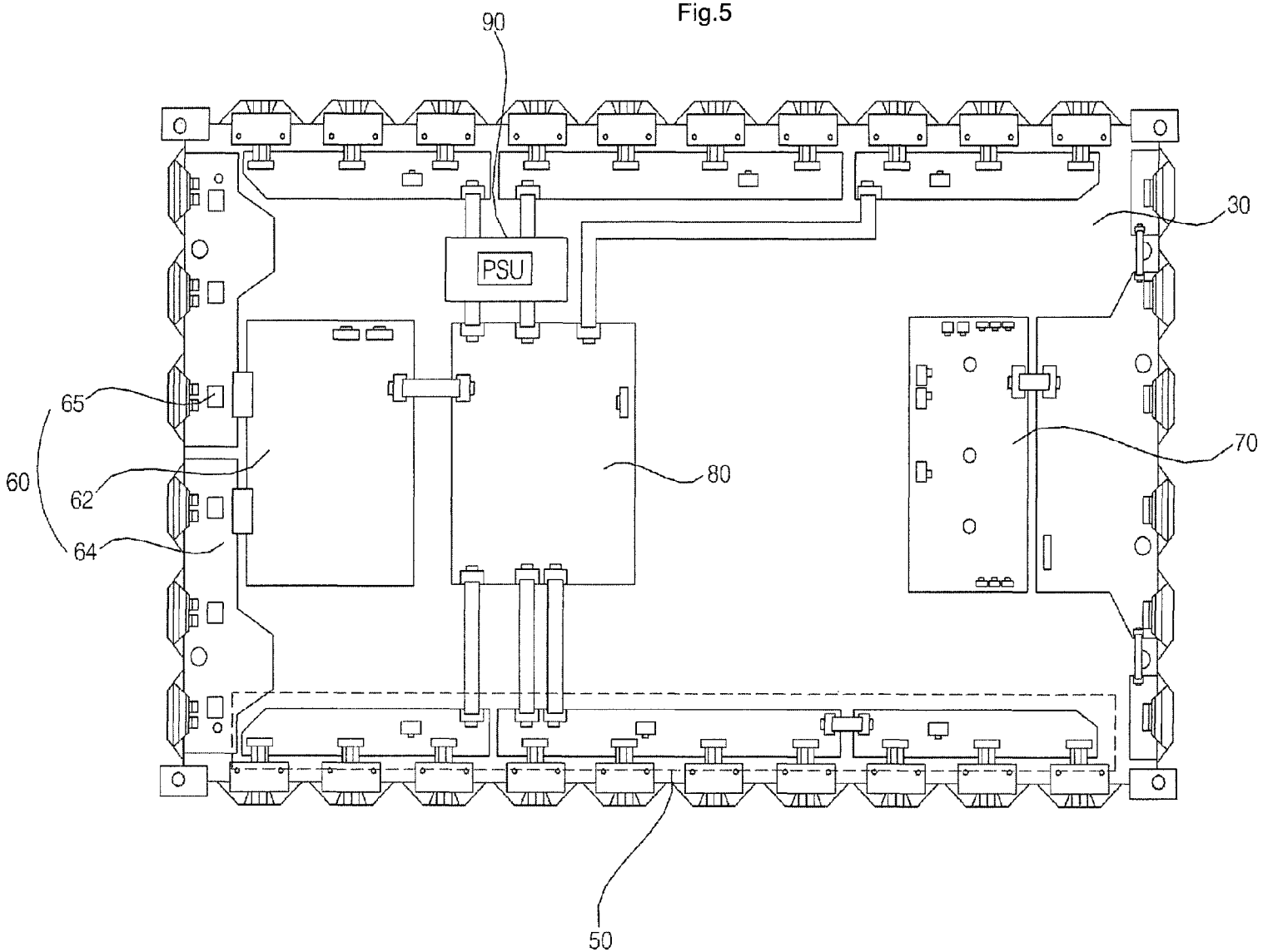
FIG. 5 is a view illustrating an embodiment of the construction of a driving apparatus for driving the plasma display panel.

FIG. 5 is a view illustrating an embodiment of the construction of a driving apparatus for driving the plasma display panel.

Referring to FIG. 5, a heat sink frame 30 is disposed on the rear surface of the panel, and functions to support the panel and also absorb and dissipate heat generated from the panel. A printed circuit board 40 for applying driving signals to the panel is also disposed on the rear surface of the heat sink frame 30.

The printed circuit board 40 may include an address driver 50 for supplying a driving signal to the address electrodes of the panel, a scan driver 60 for supplying a driving signal to the scan electrodes of the panel, a sustain driver 70 for supplying a driving signal to the sustain electrodes of the panel, a driving controller 80 for controlling the driving circuits, and a power supply unit (PSU) 90 for supplying power to each driving circuit.

The address driver 50 is configured to supply the driving signal to the address electrodes formed in the panel so that only a discharge cell, which is discharged, of a plurality of discharge cells formed in the panel is selected.

The address driver 50 may be disposed on one of upper and lower sides of the panel or both on them depending on a single scan method or a dual scan method.

The address driver 50 may include a data IC (not shown) for controlling the current applied to the address electrode. Switching for controlling the applied current may be generated in the data IC, so a great amount of heat may be generated from the data IC. Accordingly, a heat sink (not shown) for dissipating heat generated during the control process may be installed in the address driver 50.

As shown in FIG. 5, the scan driver 60 may include a scan sustain board 62 connected to the driving controller 80, and a scan driver board 64 that connects the scan sustain board 62 and the panel.

The scan driver board 64 may be divided into two parts (for example, an upper part and a lower part). Unlike the construction shown in FIG. 5, the number of the scan driver board 64 may be one or plural.

A scan IC 65 for supplying a driving signal to the scan electrode of the panel may be disposed in the scan driver board 64. The scan IC 65 may apply reset, scan and sustain signals to the scan electrode consecutively.

The sustain driver 70 supplies a driving signal to the sustain electrode of the panel.

The driving controller 80 may convert an input image signal into data, which will be supplied to the address electrodes, based on signal processing information stored in memory by performing a specific signal process on the input image signal, and arrange the converted data according to a scan sequence, and so on. Further, the driving controller 80 may control driving signal supply time points of the driving circuits by applying a timing control signal to the address driver 50, the scan driver 60, and the sustain driver 70.

FIGS. 6 to 9 are timing diagrams illustrating embodiments of a method of driving the plasma display panel by dividing the scan electrodes of the plasma display panel into two groups.

Figure 6:
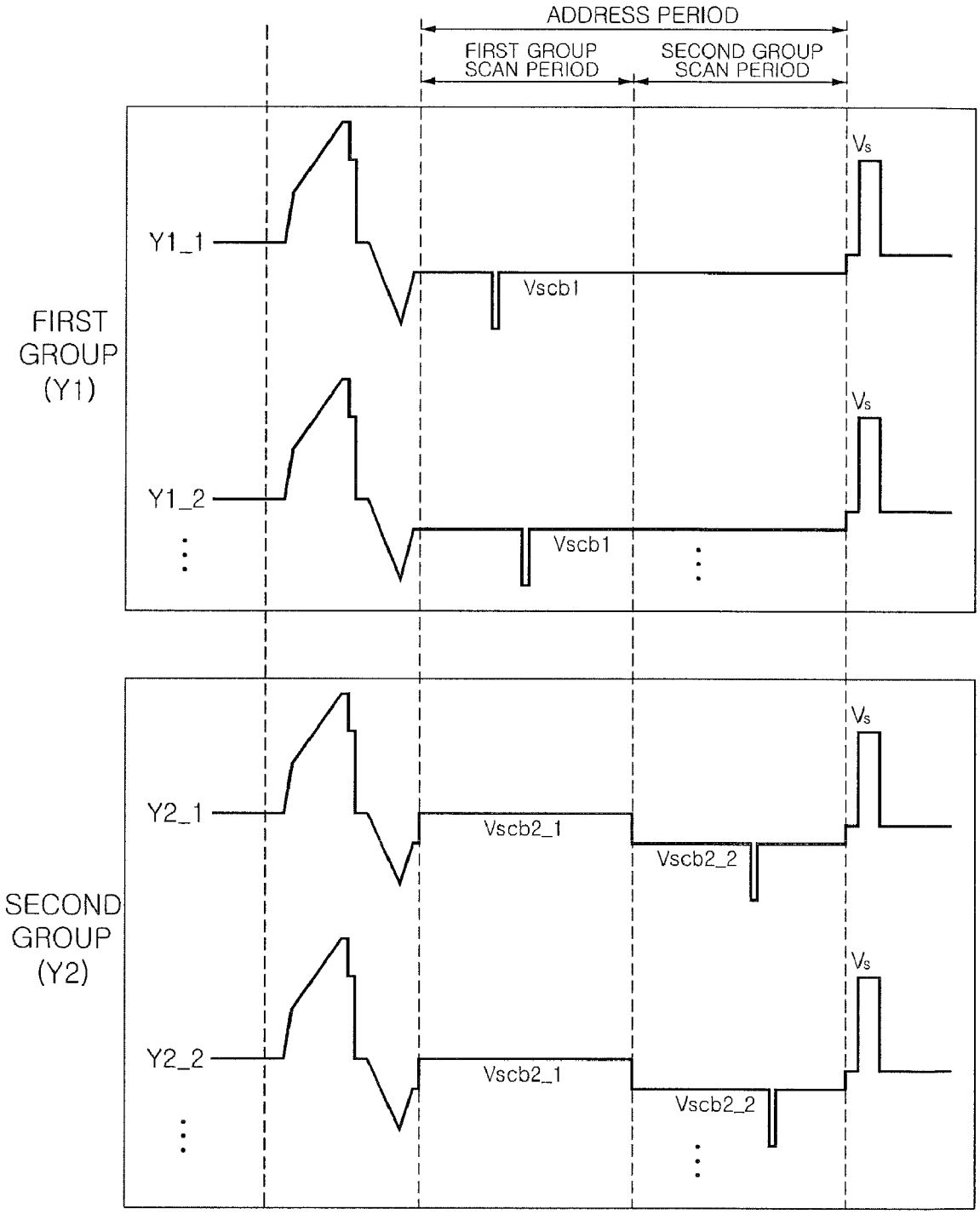
FIGS. 6 to 9 are timing diagrams illustrating embodiments of a method of driving the plasma display panel by dividing scan electrodes of the plasma display panel into two groups.

Referring to FIG. 6, the plurality of scan electrodes Y formed in the panel may be divided into two or more groups Y1 and Y2. The address period may be divided into first and second group scan periods in which a scan signal is supplied to each of the divided first and second groups. During the first group scan period, the scan signal may be sequentially supplied to scan electrodes Y1 belonging to the first group, and during the second group scan period, the scan signal may be sequentially supplied to scan electrodes Y2 belonging to the second group.

For example, the plurality of scan electrodes Y may be divided into a first group Y1 placed at the even number and a second group Y2 placed at the odd number, from the top of the panel, depending on a position formed on the panel. In another embodiment, the plurality of scan electrodes Y may be divided into a first group Y1 disposed on an upper side and a second group Y1 disposed on a lower side, on the basis of the center of the panel. The plurality of scan electrodes Y may be divided according to several methods except for the above methods. The number of the scan electrodes belonging to the first and second groups Y1 and Y2, respectively, may differ.

During the reset period, negative charges of a negative polarity (−) are formed on the scan electrodes Y for address discharge. A driving signal supplied to the scan electrodes Y during the address period is sustained to the scan bias voltage, and the address discharge is then generated when the scan signal of a negative polarity is supplied sequentially.

In the event that the plurality of scan electrodes Y are divided into the first and second groups and sequentially applied with scan signals, wall charges of a negative polarity (−), which are formed on the scan electrodes Y2 belonging to the second group Y2, may be lost during the first group scan period in which scan signals are supplied to the first group Y1. Due to this, address erroneous discharge in which address discharge is not generated even though scan signals are supplied to the scan electrodes Y2 belonging to the second group Y2 during the second group scan period may be generated.

Therefore, as shown in FIG. 6, a scan bias voltage Vscb2_1 supplied to the second group Y2 may be increased before the second group scan period in which the scan signal is supplied to the second group Y2 after the reset period (for example, during the first group scan period) in order to reduce the loss of wall charges of a negative polarity (−) formed on the scan electrodes Y2 belonging to the second group.

In other words, in the first group scan period, the scan bias voltage Vscb2_1, which is higher than a scan bias voltage Vscb1 supplied to the first group scan electrodes Y1, may be supplied to the second group scan electrodes Y2 in order to reduce address erroneous discharge.

The scan bias voltage Vscb2_1 supplied to the second group scan electrodes Y2 during the first group scan period may be lower than the sustain voltage Vs. When the scan bias voltage Vscb2_1 is lower than the sustain voltage Vs, an increase of unnecessary power consumption can be prevented and spot erroneous discharge, which is generated when the amount of wall charges formed in the scan electrodes is too many, can also be reduced.

During the first group scan period, a third scan bias voltage Vscb3 of a negative polarity is applied to the first scan group electrodes Y1. If the scan signal is applied to the scan electrodes, a potential difference between the scan signal applied to the scan electrodes and the data signal applied to the address electrode becomes too great due to the bias voltage of a negative polarity, so discharge can be generated easily.

To facilitate address discharge by increasing the potential difference between the scan signal applied to the scan electrodes and the data signal of a positive polarity, which is applied to the address electrodes X during the address period, the scan bias voltage Vscb1 supplied to the first group scan electrodes Y1 during the first group scan period and a scan bias voltage Vscb2_2 supplied to the second group scan electrodes Y2 during the second group scan period may have a voltage of a negative polarity. Accordingly, when taking the ease of a driving circuit construction into consideration, the scan bias voltage Vscb2_1 supplied to the second group scan electrodes Y2 during the first group scan period may be a ground voltage GND, and the scan bias voltage Vcb1 supplied to the first group scan electrodes Y1 during the address period may be constant.

Referring to FIG. 6, the scan bias voltage supplied to the second group scan electrodes Y2 during the address period may be changed. More specifically, in the address period, the scan bias voltage Vscb2_1 supplied to the second group scan electrodes Y2 during the first group scan period may be higher than the scan bias voltage Vscb2_2 supplied to the second group scan electrodes Y2 during the second group scan period.

In the event that the plurality of scan electrodes is divided into a first group Y1 placed at the even number and a second group Y2 placed at the odd number, different scan bias voltages Vscb1 and Vscb2_1 may be supplied to the first and second group scan electrodes Y1 and Y2 during the first group scan period as described above. Accordingly, any influence depending on interference between adjacent discharge cells can be reduced.

Further, the scan bias voltage Vsc2_1 supplied to the scan electrodes Y2 belonging to the second group during the first group scan period may have a value greater than 2. In this case, a high scan bias voltage Vscb2_1 may be supplied to a scan electrode to which the scan bias voltage Vsc2_1 is subsequently supplied rather than a scan electrode to which the scan bias voltage Vsc2_1 is first supplied, of the second group scan electrodes Y2, during the first group scan period. Thus, loss of wall charges formed in the scan electrodes in the reset period can be reduced more effectively.

The driving waveform as described with reference to FIG. 6 may be applied to some of the plurality of subfields constituting one frame. For example, the driving waveform may be applied to at least one of subfields posterior to a second subfield.

Figure 7:
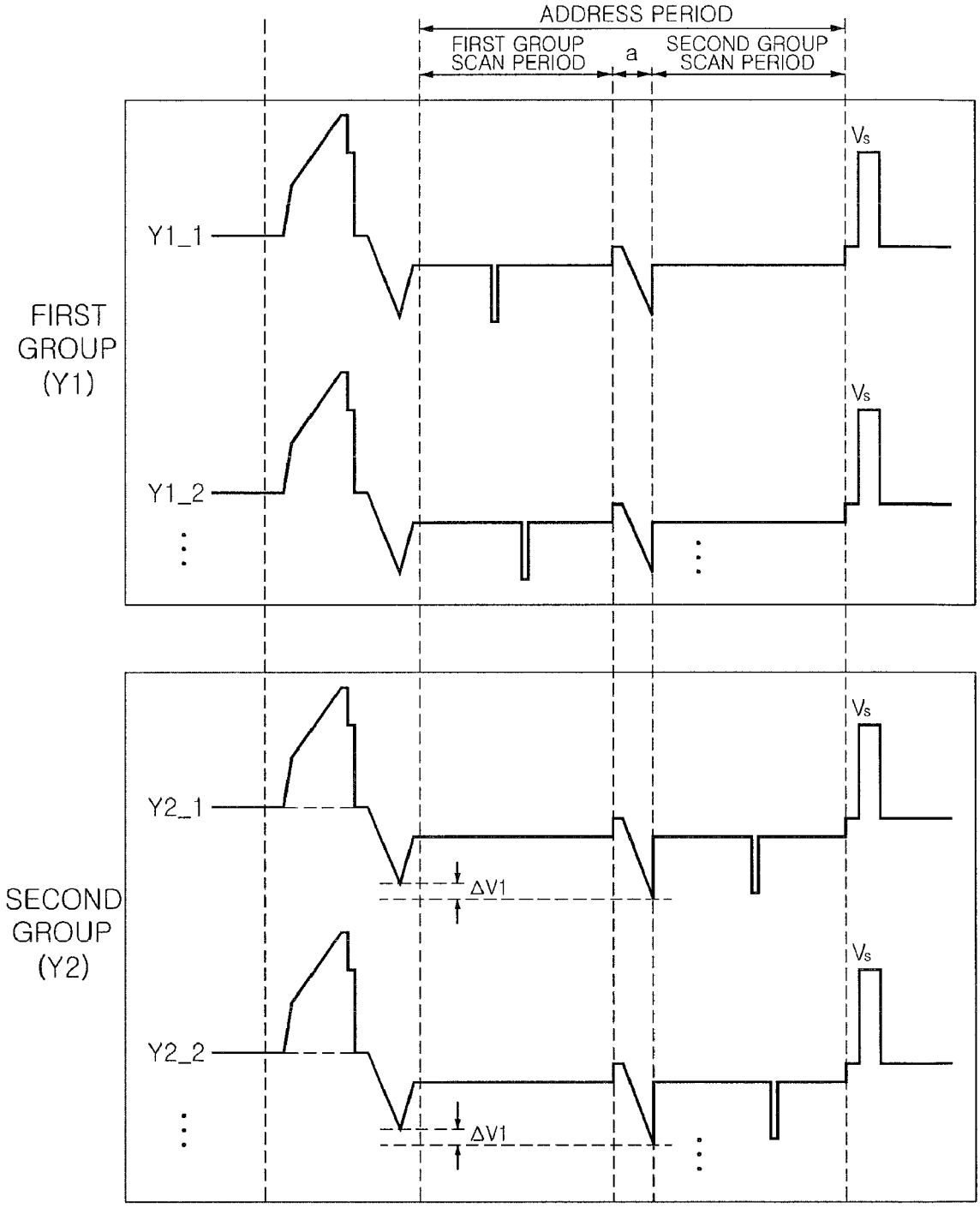

FIG. 7 shows a timing diagram of another embodiment of driving signal waveforms in which the plurality of scan electrodes Y are divided into first and second groups and then sequentially supplied with scan signals. The same parts as those described with reference to FIG. 6, of description of driving waveforms shown in FIG. 7, will not be described for simplicity.

Referring to FIG. 7, there may exist an intermediate period "a" in which a signal that gradually drops is supplied to the scan electrodes Y between a first group scan period in which scan signals are sequentially supplied to first group scan electrodes Y1 and a second group scan period in which scan signals are sequentially supplied to second group scan electrodes Y2.

As described above, in the setdown period of the reset period, the setdown signal that gradually drops is supplied to the scan electrodes Y, so unnecessary electric charges of wall charges formed in the setup period are erased.

In the event that the scan electrodes Y are divided into a plurality of groups and then sequentially supplied with scan signals, wall charges of a negative polarity (−) formed in the scan electrodes Y2 belonging to the second group scan electrodes Y2 may be lost during the first group scan period. In other words, at a time point at which the address period begins, the amount of wall charges formed in the second group scan electrodes Y2 may be set greater than the amount of wall charges formed in the first group scan electrodes Y1 in order to compensate for the loss of wall charges.

For example, the amount of wall charges formed in the second group scan electrodes Y2 can be increased at a time point at which the address period begins by increasing the lowest voltage of a setdown signal supplied to the second group scan electrodes Y2 during the reset period (an absolute value is reduced), as shown in FIG. 7. Further, after the first group scan period is finished, a signal that gradually drops may be supplied to the second group scan electrodes Y2 so as to erase unnecessary wall charges.

To this end, the lowest voltage of a first setdown signal supplied to the second group scan electrodes Y2 during the reset period may differ from the lowest voltage of a second setdown signal supplied to the second group scan electrodes Y2 during the intermediate period "a". More specifically, the lowest voltage of the first setdown signal may be higher than the lowest voltage of the second setdown signal.

Furthermore, to compensate for the loss of wall charges formed in the second group scan electrodes Y2 more effectively, the lowest voltage of the first setdown signal supplied to the second group scan electrodes Y2 during the reset period may have a value greater than 2. In this case, a setdown signal having a high lowest voltage may be supplied to a scan electrode to which the first setdown signal is subsequently supplied rather than a scan electrode to which the first setdown signal is first supplied, of the second group scan electrodes Y2.

For example, a lowest voltage difference ΔV2 between the first and second setdown signals supplied to a second scan electrode Y2_2 of the second group Y2 may be greater than a lowest voltage difference ΔV1 between the first and second setdown signals supplied to a first scan electrode Y2_1 of the second group Y2.

When considering easiness in terms of the construction of the driving circuit for generating the driving signals of the waveforms, a second setdown signal that gradually drops may also be applied to the first group scan electrodes Y1 during the intermediate period "a" between the first and second group scan periods, as shown in FIG. 7. In other words, in case where the second setdown signal is supplied to only the second group scan electrodes Y2 during the intermediate period "a", a circuit configuration for supplying the setdown signal may differ on a first- or second-group basis.

Referring to FIG. 7, the lowest voltage of the setdown signal supplied to the first group scan electrodes Y1 during the reset period may be lower than the lowest voltage of the setdown signal supplied to the second group scan electrodes Y2 during the reset period. Further, when taking the ease of a circuit configuration into consideration, the lowest voltage of the first setdown signal supplied to the first group scan electrodes Y1 during the reset period may be identical to the lowest voltage of the second setdown signal supplied to the first and second group scan electrodes Y1 and Y2 during the intermediate period "a".

For the ease of a driving circuit configuration, falling slopes of the first and second setdown signals may be identical. In this case, the lowest voltages of the first and second setdown signals can be varied as described above by controlling a width of the setdown signal (that is, falling times of the first and second setdown signals).

Further, an amount of the lowest voltage of the first setdown signal supplied to the second group scan electrodes Y2 during the reset period may be in reverse proportional to an amount of the lowest voltage of the second setdown signal supplied to the second group scan electrodes Y2 during the intermediate period "a". In other words, as the lowest voltage of the first setdown signal supplied to one of the second group scan electrodes Y2 during the reset period becomes low, the lowest voltage of the second setdown signal supplied to the scan electrode during the intermediate period "a" may rise. Since the amount of wall charges formed in the scan electrode at the start time point of the address period is decreased as the lowest voltage of the first setdown signal supplied to the second group scan electrode Y2 during the reset period is lowered, an erase amount of wall charges formed in the scan electrode can be decreased by raising the lowest voltage of the second setdown signal supplied to the scan electrode during the intermediate period "a". Accordingly, the second group scan electrode Y2 may be sustained in an appropriate wall charge state for address discharge.

Unlike FIG. 7, the setdown signal may not be supplied to the second group scan electrodes Y2 during the reset period. Thus, the amount of wall charges of a negative polarity (−), which are formed in the second group scan electrodes Y2 at the address period start time point, can be further increased.

The driving waveform as described with reference to FIG. 7 may be applied to some of a plurality of subfields constituting one frame. For example, the driving waveform may be applied to at least one of subfields posterior to a second subfield. Furthermore, the scan bias voltage supplied to the second group scan electrodes Y2 may be varied as shown in FIG. 6.

Figure 8:
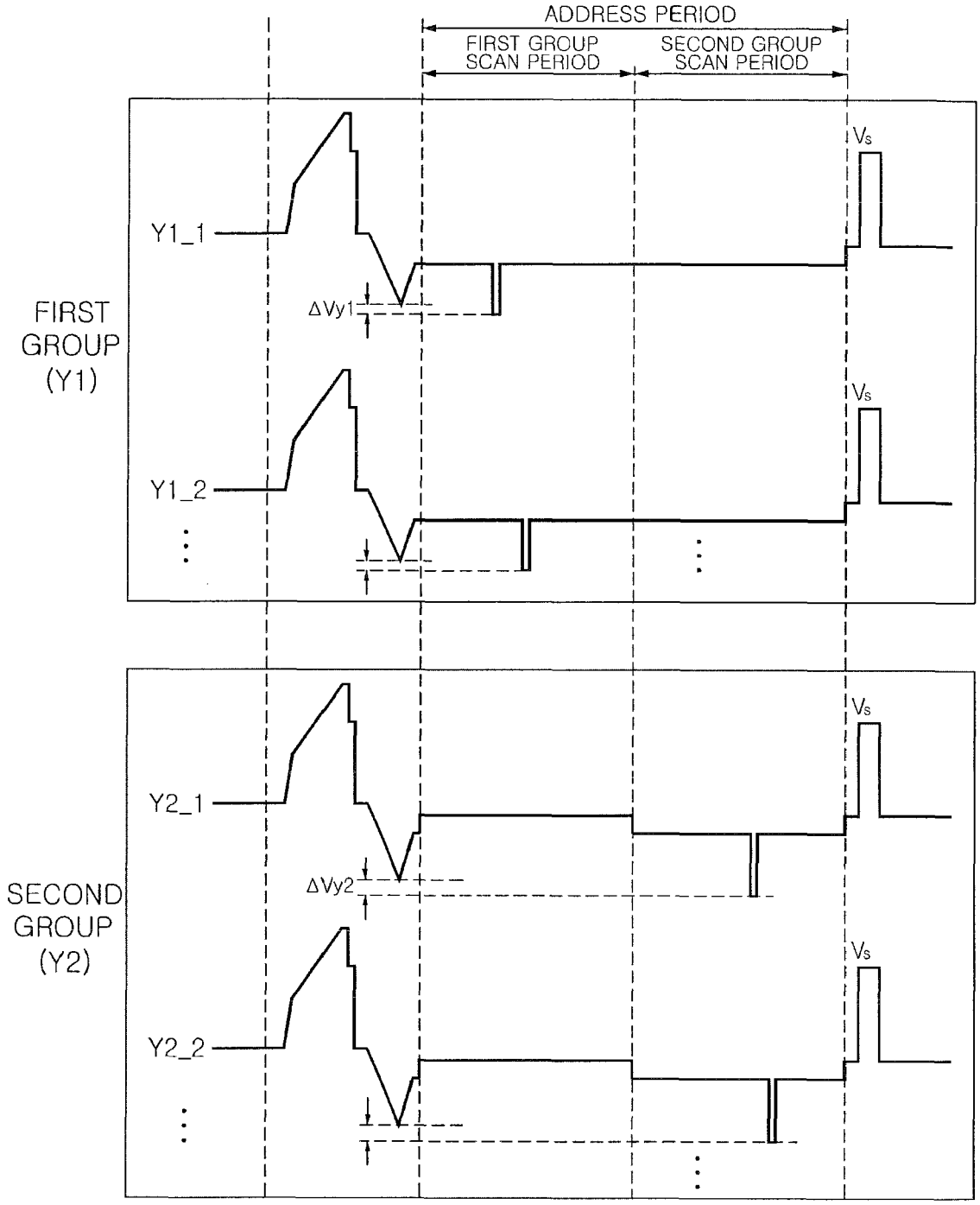

Referring to FIG. 8, the lowest voltage of the setdown signal supplied to the first and second scan group electrodes Y1 and Y2 during the reset period may be set higher than the lowest voltage of the scan signal. In this case, the amount of wall charges formed in the first and second scan group electrodes Y1 and Y2 at the start time point of the address period can be further increased, so address discharge can be generated stably.

In order to compensate for the loss of wall charges, formed in the second group scan electrodes Y2, during the first group scan period as described above, the lowest voltage of the setdown signal supplied to the second group scan electrodes Y2 during the reset period may be increased. To this end, a lowest voltage difference ΔVy2 between the setdown signal and the scan signal supplied to the second scan group electrodes Y2 may be set greater than a lowest voltage difference ΔVy1 between the setdown signal and the scan signal supplied to the first scan group electrodes Y1.

Figure 9:
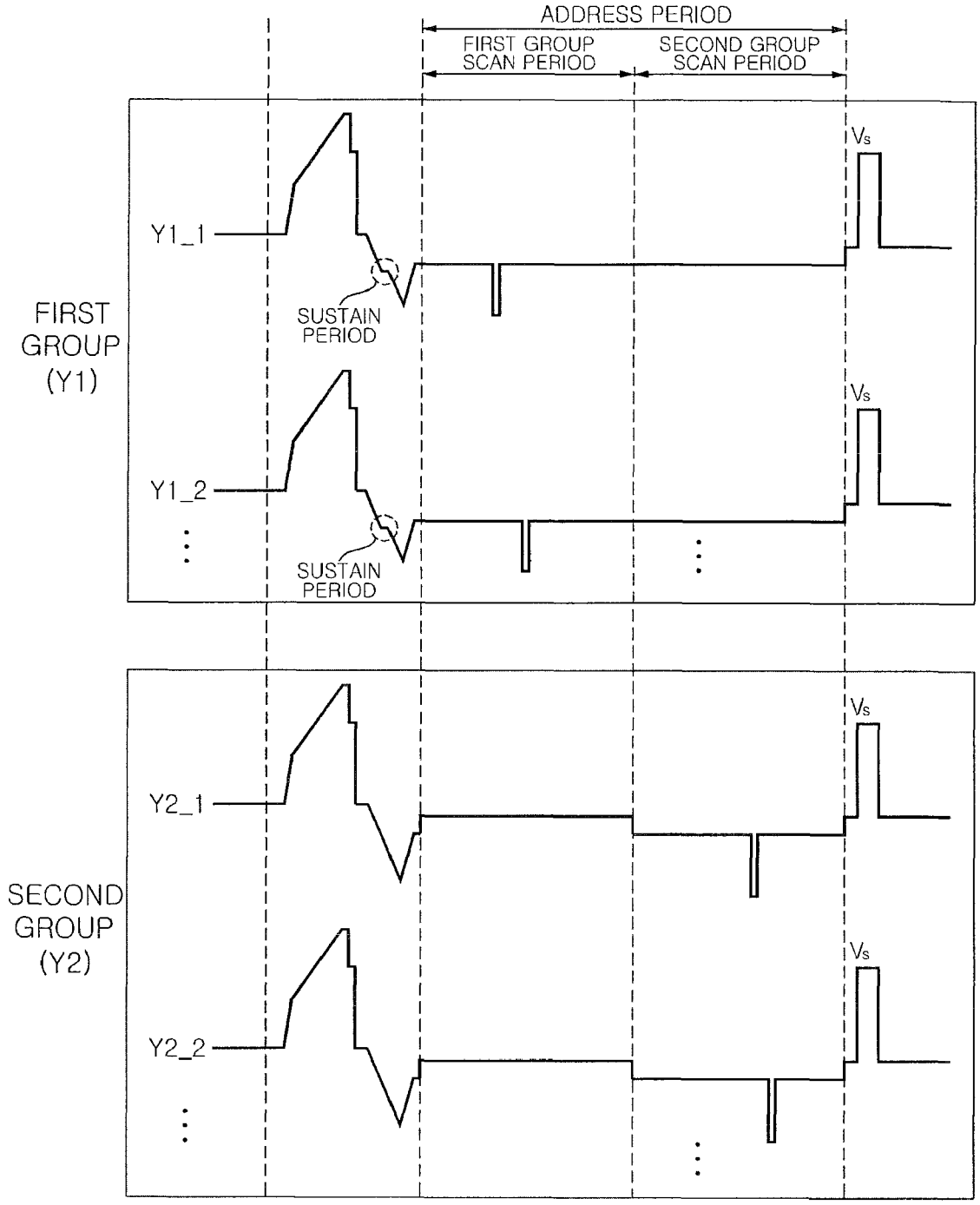

Referring to FIG. 9, a falling period of the setdown signal supplied to the scan electrodes during the reset period may have a discontinuous waveform. In other words, the falling period of the setdown signal may include a first falling period in which a voltage gradually drops to a first voltage, a sustain period in which the voltage is sustained to the first voltage, and a second falling period in which the voltage gradually drops from the first voltage. Further, the setdown signal may include two or more sustain periods.

If a setdown signal having a discontinuous falling period is supplied to the scan electrode during the reset period as described above, the amount of wall charges formed in the scan electrode at the start time point of the address period can be increased and therefore address discharge can be stabilized.

The setdown signal having the discontinuous falling period as shown in FIG. 9 may be supplied to at least one of the first group scan electrodes Y1. Alternatively, the setdown signal having the discontinuous falling period may be applied to at least one of the second group scan electrodes Y2 or both the first and second group scan electrodes Y1 and Y2.

The driving waveforms as described with reference to FIGS. 8 and 9 may be applied to some of a plurality of subfields constituting one frame. For example, the driving waveform may be applied to at least one of subfields posterior to a second subfield.

Further, the driving signal waveforms as shown in FIGS. 6 to 9 may be applied to one of a plurality of subfields at the same time.

Figure 10:
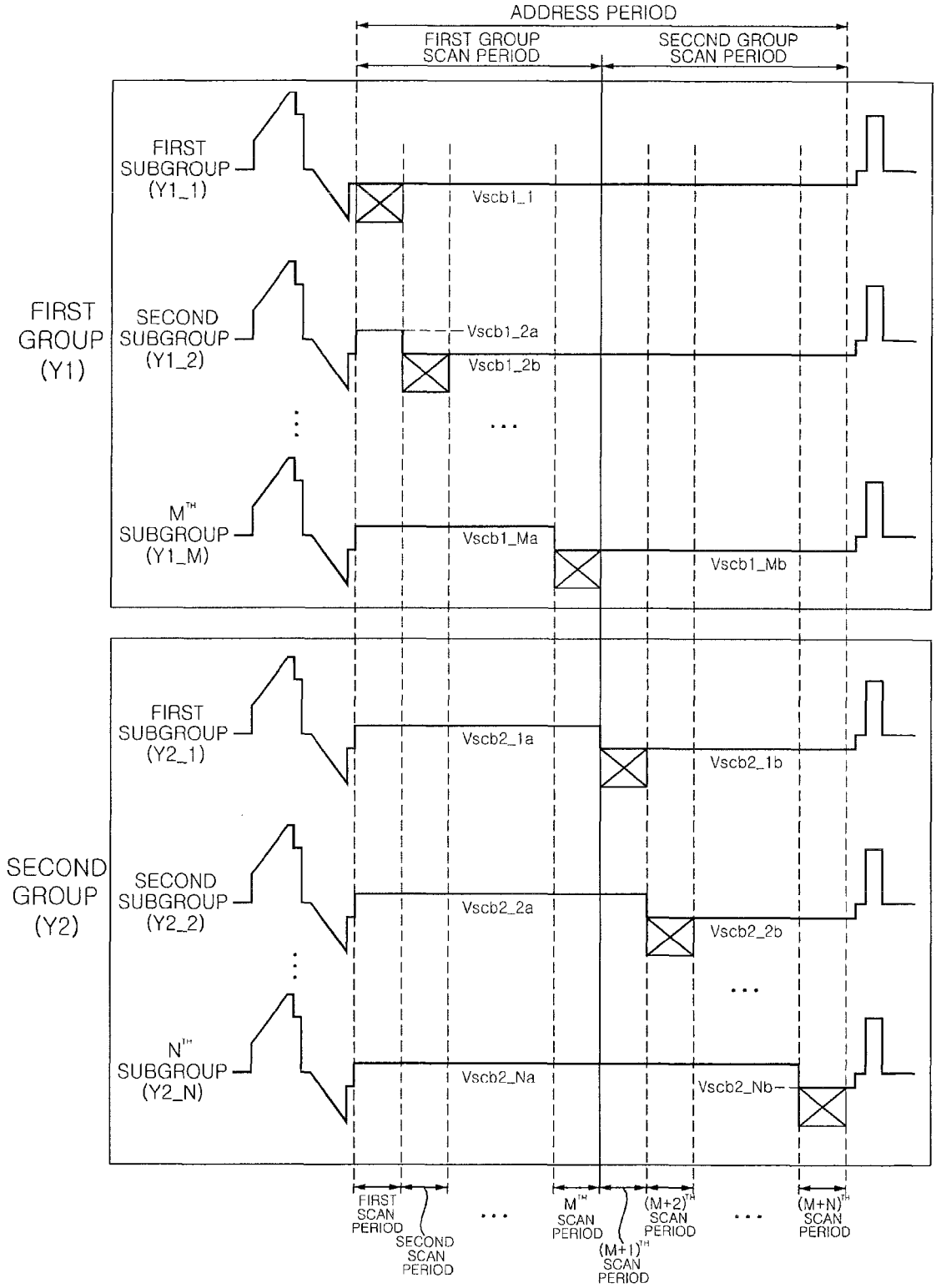
FIGS. 10 and 11 are timing diagrams illustrating embodiments of a method of driving the plasma display panel by dividing scan electrodes of the plasma display panel into two or more groups.

FIG. 10 is a timing diagram illustrating an embodiment of a method in which the scan electrode groups divided according to the above methods are driven with them being divided into two or more subgroups, respectively.

Referring to FIG. 10, the plurality of scan electrodes Y formed in the plasma display panel may be divided into first and second groups Y1 and Y2. For example, the plurality of scan electrodes Y may be divided into the first group Y1 placed at the even number and the second group Y2 placed at the odd number on the basis of the top of the panel according to a position formed on the panel. In another embodiment, the plurality of scan electrodes Y may be divided into the first group Y1 disposed on an upper side of the panel and the second group Y1 disposed on a lower side of the panel on the basis of the center of the panel. Alternatively, the plurality of scan electrodes Y may be divided according to several methods other than the above methods. Furthermore, the number of the scan electrodes belonging to the first and second groups Y1 and Y2, respectively, may differ.

Alternatively, the first and second group scan electrodes Y1 and Y2 may be divided into a plurality of subgroups. In this case, the plurality of scan electrodes may be sequentially supplied with the scan signals in order of the first and second groups, or may be sequentially supplied with the scan signals on a divided-subgroup basis within the first and second groups.

The number M of the subgroups belonging to the first group may differ from the number N of the subgroups belonging to the second group.

Referring to FIG. 10, a plurality of subgroups Y11, . . . , Y1_M and Y2_1, . . . , Y2_N are sequentially supplied with the scan signals during corresponding scan periods (first to $(M+N)^{th}$ scan periods). In other words, the scan signal may be sequentially supplied to the first subgroup scan electrodes Y11 belonging to the first group during the first scan period, the scan signal may be sequentially supplied to the second subgroup scan electrodes Y12 belonging to the first group during the second scan period, and the scan signal may be sequentially supplied to the first subgroup scan electrodes Y2_1 belonging to the second group during the $(M+1)^{th}$ scan period.

As described above, in each subgroup, wall charges of a negative polarity (−) formed during the reset period may be lost before a period in which the scan signal is supplied, so address erroneous discharge may be generated. For example, in the case of the second subgroup scan electrodes Y12 belonging to the first group, wall charges formed in the reset period may be lost during the first scan period, and in the case of the first subgroup scan electrodes Y2_1 belonging to the second group, wall charges formed in the reset period may be lost during the first to $M^{th}$ scan periods. Due to this, address erroneous discharge may be generated.

In order to reduce the loss of wall charges, the amount of the scan bias voltage may be increased during a period from the start time point of the address period until before the supply of the scan signal to a corresponding subgroup.

The amount of the scan bias voltage described above may be smaller than the sustain voltage Vs. If the scan bias voltage is lower than the sustain voltage Vs, an increase of unnecessary power consumption can be prevented and spot erroneous discharge, which occurs when the amount of wall charges formed in the scan electrodes is too many, can also be reduced.

In other words, in the case of the second subgroup scan electrodes Y1_2 belonging to the first group, a scan bias voltage Vscb1_2*a* supplied during the first scan period may be higher than a scan bias voltage Vscb1_2*b* during periods posterior to the first scan period (that is, the second to $(M+N)^{th}$ scan periods). Further, in the case of the $M^{th}$ subgroup scan electrodes Y1_M belonging to the first group, a scan bias voltage Vscb1_Ma supplied during the first to $(M-1)^{th}$ scan periods may be higher than a scan bias voltage Vscb1_Mb supplied during the $M^{th}$ to $(M+N)^{th}$ scan periods.

In a similar way, in the second group, in the case of the first subgroup scan electrodes Y2_1, a scan bias voltage Vscb2_1*a* supplied during the first to $M^{th}$ scan periods may be higher than a scan bias voltage Vscb2_1*b* supplied during the $(M+1)^{th}$ to $(M+N)^{th}$ scan periods, in the case of the second subgroup scan electrodes Y2_2, a scan bias voltage Vscb2_2*a* supplied during the first to $(M+1)^{th}$ scan periods may be higher than a scan bias voltage Vscb2_2*b* supplied during the $(M+_2)^{th}$ to $(M+N)^{th}$ scan periods, or in the case of the $N^{th}$ subgroup scan electrodes Y2_N, a scan bias voltage Vscb2_Na supplied during the first to $((M+N)-1)^{th}$ scan periods may be higher than a scan bias voltage Vscb2_Nb supplied during the $(M+N)^{th}$ scan period.

For the above reason, in accordance with the driving signal according to an embodiment of the present invention, the scan bias voltages supplied to specific two subgroups belonging to the first group at least any time point of the address period may differ. The scan bias voltages supplied to specific two subgroup belonging to the second group at least any time point of the address period may differ. The scan bias voltages supplied to any one subgroup belonging to the first group and any one subgroup belonging to the second group, at least any time point of the address period, may differ.

Referring to FIG. 10, in the case of the first group, the scan bias voltages supplied during the first scan period differ in the first and second subgroups Y11 and Y1_2 or the first and $M^{th}$ subgroups Y1_1 and Y1_M, and the scan bias voltages supplied during the second to $(M-1)^{th}$ scan periods differ in the second and $M^{th}$ subgroups Y12 and Y1_M.

In the case of the second group, the scan bias voltages supplied during the $(M+1)^{th}$ scan period differ in the first and second subgroups Y2_1 and Y2_2 or the first and $N^{th}$ subgroups Y2_1 and Y2_M. The scan bias voltages supplied during the $(M+_2)^{th}$ to $((M+N)-1)^{th}$ scan periods differ in the second and $N^{th}$ subgroups Y2_2 and Y2_N.

Furthermore, the scan bias voltages supplied during the first scan period differ in the first subgroup Y11 belonging to the first group and a subgroup belonging to the second group. The scan bias voltages supplied during the second scan period differ in the second subgroup Y1_2 belonging to the first group and a subgroup belonging to the second group. The scan bias voltages supplied during the $M^{th}$ scan period differ in the $M^{th}$ subgroup Y1_M belonging to the first group and a subgroup belonging to the second group.

As described above, in each of the plurality of subgroups, during the periods in which the scan signal is supplied, the scan bias voltage of a negative polarity may be supplied.

For the ease of a driving circuit configuration, the scan bias voltages Vscb1_1, Vscb1_2*b*, . . . , Vscb1_Mb, Vscb2_1*b*, . . . , Vscb2_2*b*, . . . , Vscb2_Nb supplied during the periods in which the scan signal is supplied may be identical. The scan bias voltages Vscb1_2*a*, Vscb1_Ma, Vscb2_1*a*, . . . , Vscb2_2*a*, . . . , Vscb2_Na supplied during the periods before the supply of the scan signal may be a ground voltage GND.

In other words, if the above-mentioned voltage levels are employed, the driving signals of the waveform as shown in FIG. 10 can be supplied to the panel by controlling only the switching timing of the driving circuit without greatly changing a driving circuit configuration for supplying the driving signal waveforms as described with reference to FIGS. 4 to 9.

Furthermore, as described above, as the supply of the scan signal is later, the loss of wall charges may be increased. Thus, the amount of the scan bias voltages Vscb1_2*a*, . . . , Vscb1_Ma, Vscb2_1*a*, . . . , Vscb2_2*a*, Vscb2_Na supplied to the respective subgroups during the periods before the scan signal is supplied may be increased as the driving sequence becomes late. In other words, in the first group, during the first scan period, the scan bias voltage Vscb1_Ma supplied to the $M^{th}$ subgroup Y1_M may be higher than the scan bias voltage Vscb1_2*a* supplied to the second subgroup Y1_2. In the second group, during the first scan period, the scan bias voltage Vscb2_2*a* supplied to the second subgroup Y2_2 may be higher than the scan bias voltage Vscb2_1*a* supplied to the first subgroup Y2_1. Further, during the first scan period, the scan bias voltage supplied to N subgroups belonging to the second group Y2 may be higher than the scan bias voltage supplied to M subgroups belonging to the first group Y1.

Figure 11:
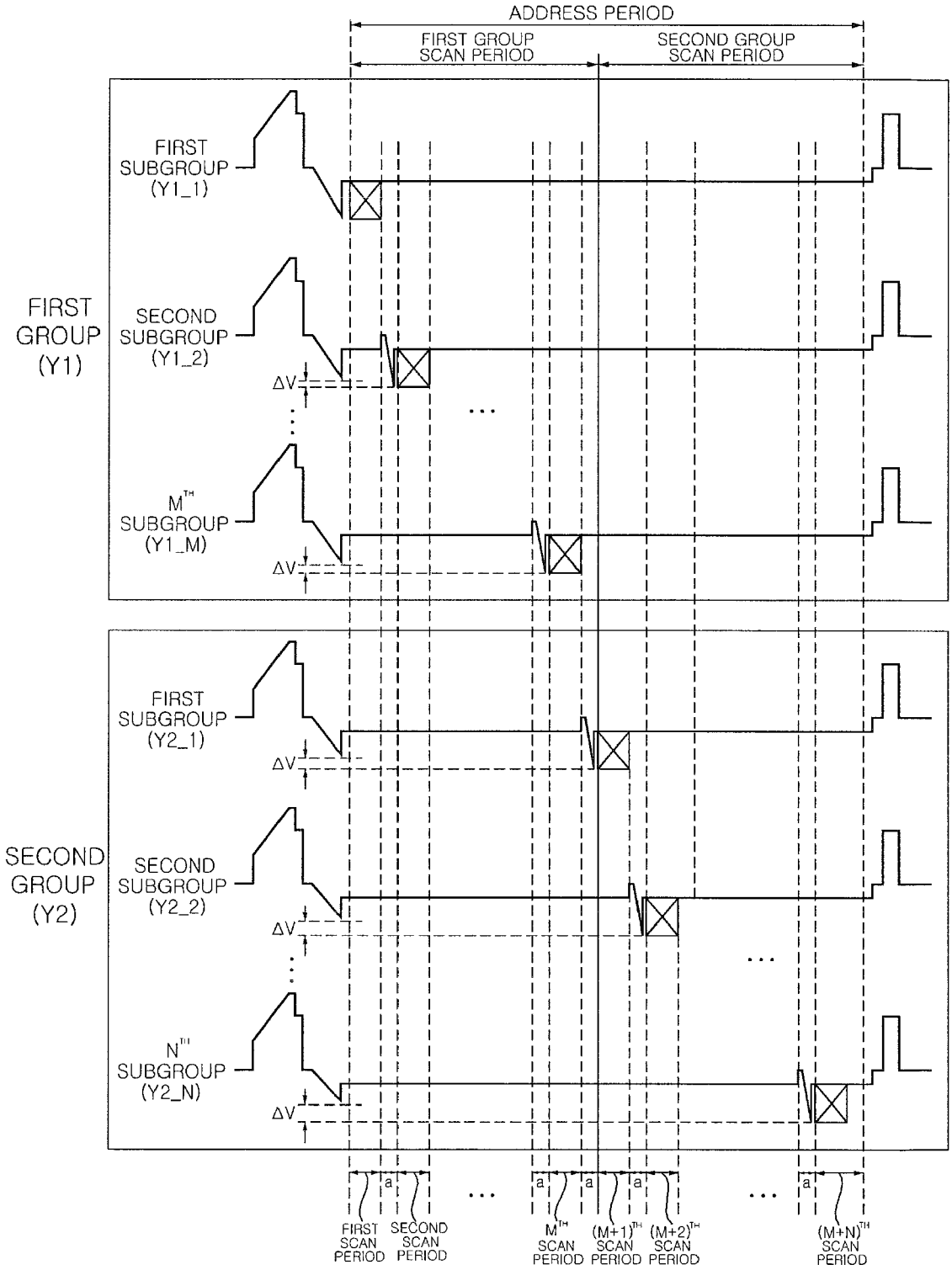

FIG. 11 is a timing diagram illustrating another embodiment of a method in which a plurality of scan electrodes are driven with them being divided into subgroups as described above. The same parts as those described with reference to FIG. 10, of description of driving waveforms shown in FIG. 11, will not be described for simplicity.

Referring to FIG. 11, a signal that gradually drops may be supplied to each of the plurality of subgroups in an intermediate period "a" between two adjacent scan periods of a plurality of scan periods (first to $(M+N)^{th}$ scan periods) in which the scan signals are supplied, so unnecessary wall charges may be erased before the supply of the scan signal.

Furthermore, in order to compensate for the loss of wall charges, which subsequently occurs, by increasing the amount of wall charges formed in the scan electrode at the start time point of the address period, the lowest voltage of a setdown signal supplied to the scan electrodes during the reset period may be increased (an absolute value is lowered).

For example, as shown in FIG. 11, in second to $M^{th}$ subgroups belonging to the first group or subgroups belonging to the second group, the amount of wall charges on the scan electrodes at the start time point of the address period may be increased by raising the lowest voltage of a first setdown signal supplied during the reset period, and the amount of wall charges may be sustained in an appropriate wall charge state for address discharge by supplying a second setdown signal right before the scan period of the subgroup in order to erase unnecessary wall charges.

For the ease of a driving circuit configuration, the falling slopes of the first and second setdown signals may be identical. In this case, the lowest voltages of the first and second setdown signals can be varied, as described above, by controlling the width of the setdown signal (that is, the falling times of the first and second setdown signals).

Furthermore, in order to compensate for the loss of wall charges formed in the scan electrodes more effectively, the lowest voltage of the first setdown signal supplied to the scan electrodes during the reset period may have a value greater than 2. In this case, the lowest voltage of the first setdown signal of a subgroup in which the scan period is placed anterior to the reset period may be lower than the lowest voltage of the first setdown signal of a subgroup in which the scan period is placed posterior to the reset period. For example, the lowest voltage of the first setdown signal supplied to the second subgroup Y12 belonging to the first group may be lower than the lowest voltage of the first setdown signal supplied to the $M^{th}$ subgroup Y1_M belonging to the first group, and the lowest voltage of the first setdown signal supplied to the first subgroup Y2_1 belonging to the second group may be lower than the lowest voltage of the first setdown signal supplied to the second subgroup Y2_2 belonging to the second group. Accordingly, a difference ΔV between the lowest voltages of the first and second setdown signals of the subgroups may be increased in a subgroup in which the scan period is positioned behind.

The amount of the lowest voltage of the first setdown signal supplied during the reset period may be in reverse proportion to that of the lowest voltage of the second setdown signal supplied during the intermediate period "a". In other words, the lower the lowest voltage of the first setdown signal supplied to the subgroup during the reset period, the higher the lowest voltage of the second setdown signal supplied to the subgroup during the intermediate period "a".

Unlike FIG. 11, in the remaining subgroups other than the first subgroup Y11 belonging to the first group, the setdown signal may not be supplied during the reset period. Accordingly, the amount of wall charges of a negative polarity (−), which are formed in the scan electrodes at the address period start time point, can be further increased.

For the ease of the construction and control of the driving circuit, the slope of the first setdown signal supplied during the reset period may be identical to that of the second setdown signal supplied during the intermediate period "a". The lowest voltage of the second setdown signal may be identical to the lowest voltage of the first setdown signal supplied to the first subgroup Y1_1 belonging to the first group during the reset period. Furthermore, in the remaining subgroups other than the first subgroup Y11 belonging to the first group, the lowest voltage of the first setdown signal supplied during the reset period may be identical.

In other words, if the above voltage levels are employed, the driving signals of the waveforms as shown in FIG. 11 can be supplied to the panel by controlling only the switching timing of the driving circuit without greatly changing the conventional driving circuit configuration.

Further, for the ease of the construction and control of the driving circuit, in each of the intermediate periods "a" shown in FIG. 11, the second setdown signals may be supplied to the plurality of subgroups at the same time.

The driving waveforms as described with reference to FIGS. 10 and 11 may be applied to some of a plurality of subfields constituting one frame. For example, the driving waveforms may be applied to at least one of subfields posterior to a second subfield.

Moreover, the driving signal waveforms as shown in FIGS. 10 and 11 may be applied in any one of the plurality of subfields at the same time, or may be applied along with the driving signal waveforms as shown in FIGS. 6 to 9, if appropriate.

Hereinafter, more detailed embodiments of a method of driving the scan electrodes by dividing them into a plurality of subgroups are described by taking a case where first and second groups are respectively divided into two subgroups and then sequentially supplied with the scan signal as an example.

The plurality of scan electrodes Y formed in the plasma display panel may be divided into the first and second groups Y1 and Y2. For example, the plurality of scan electrodes Y may be divided into a first group Y1 placed at the even number and a second group Y2 placed at the odd number, from the top of the panel, depending on a position formed on the panel. In another embodiment, the plurality of scan electrodes Y may be divided into a first group Y1 disposed on an upper side of the panel and a second group Y2 disposed on a lower side of the panel, on the basis of the center of the panel.

Further, the scan electrodes Y1 belonging to the first group may divided into a first subgroup and a second subgroup. The scan electrodes Y2 belonging to the second group may be divided into a third subgroup and a fourth subgroup.

As an embodiment of a method in which each of the first and second groups is divided into two subgroups, each of the first and second groups may be divided into a first subgroup placed at the even numbers and a second subgroup Y2 placed at the odd number, of the scan electrodes Y1 belonging to the first group, or a first subgroup Y disposed on an upper side and a second subgroup disposed on a lower side, on the basis of the center of the first group. Alternatively, the plurality of scan electrodes may be divided into four or more subgroups according to several methods except for the above methods.

Figure 12:
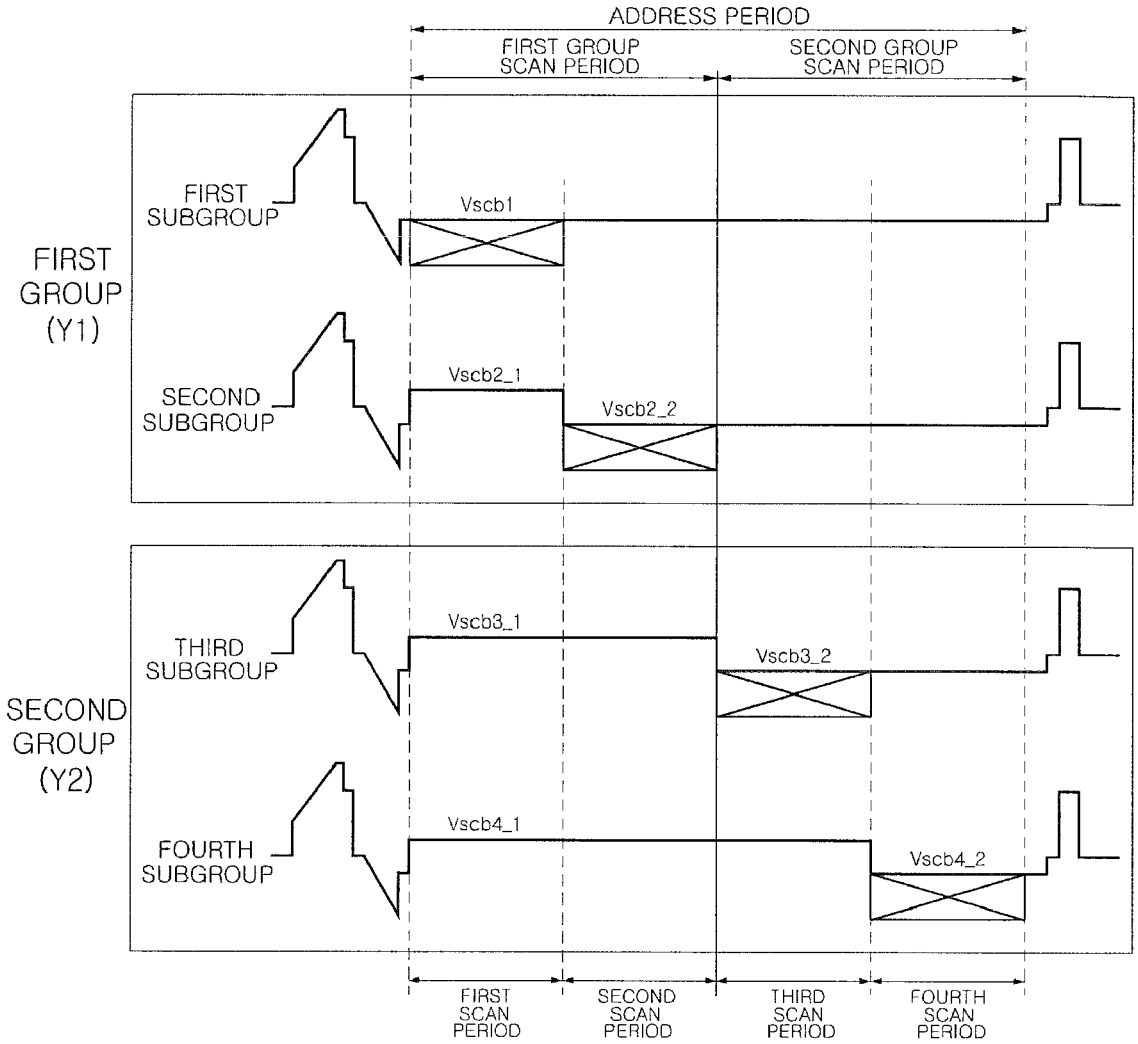
FIGS. 12 to 15 are timing diagrams illustrating embodiments of a method of driving the plasma display panel by dividing scan electrodes of the plasma display panel into four groups.

Referring to FIG. 12, during a first scan period, a scan bias voltage Vscb1 supplied to the first subgroup scan electrodes may differ from a scan bias voltage Vscb2_1 supplied to the second subgroup scan electrodes. In addition, in order to reduce the loss of wall charges in the second subgroup scan electrodes, which occurs during the first scan period, the scan bias voltage Vscb2_1 supplied to the second subgroup scan electrodes may be higher than the scan bias voltage Vscb1 supplied to the first subgroup scan electrodes.

During a third scan period, a scan bias voltage Vscb3_2 supplied to the third subgroup scan electrodes may differ from a scan bias voltage Vscb4_1 supplied to the fourth subgroup scan electrodes. In order to reduce the loss of wall charges in the fourth subgroup scan electrodes, which is generated during the first to third scan periods, during the third scan period, the scan bias voltage Vscb4_1 supplied to the fourth subgroup scan electrodes may be higher than the scan bias voltage Vscb3_2 supplied to the third subgroup scan electrodes.

Furthermore, during the first scan period, the scan bias voltage Vscb1 supplied to the first subgroup scan electrodes may differ from scan bias voltages Vscb3_1 and Vscb4_1 supplied to the third and fourth subgroup scan electrodes. In order to reduce the loss of wall charges in the third and fourth subgroup scan electrodes, which occurs during the first scan period, during the first scan period, the scan bias voltages Vscb3_1 and Vscb4_1 supplied to the third and fourth subgroup scan electrodes may be higher than the scan bias voltage Vscb1 supplied to the first subgroup scan electrodes.

Moreover, during the second scan period, a scan bias voltage Vscb2_2 supplied to the second subgroup scan electrodes may differ from the scan bias voltages Vscb3_1 and Vscb4_1 supplied to the third and fourth subgroup scan electrodes. In order to reduce the loss of wall charges in the third and fourth subgroup scan electrodes, which occurs during the second scan period, during the second scan period, the scan bias voltages Vscb3_1 and Vscb4_1 supplied to the third and fourth subgroup scan electrodes may be higher than the scan bias voltage Vscb2_2 supplied to the second subgroup scan electrodes.

As described above, in order to effectively reduce the loss of wall charges formed in the scan electrodes, the amount of the scan bias voltage may be increased in order of Vscb1, Vscb2_1, Vscb3_1, and Vscb4_1.

However, when considering the ease of the construction and control of the driving circuit, the amounts of the scan bias voltages Vscb2_1, Vscb3_1, and Vscb4_1 may be identical, and the amounts of the scan bias voltages Vscb1, Vscb2_2, Vscb3_2, and Vscb4_2 may be identical.

The scan bias voltages Vscb2_1, Vscb3_1, and Vscb4_1, which are high as described above, may be lower than the sustain voltage Vs. If the scan bias voltages Vscb2_1, Vscb3_1, and Vscb4_1 are lower than the sustain voltage Vs, an increase of unnecessary power consumption can be prevented and spot erroneous discharge, which occurs when the amount of wall charges formed in the scan electrodes is too many, can be reduced.

The first group may include scan electrodes placed at the even numbers, of a plurality of scan electrodes formed in a panel, and the second group include scan electrodes placed at the odd numbers, of the plurality of scan electrodes formed in the panel. Further, the first and second subgroups may include scan electrodes placed at the even numbers and scan electrodes placed at the odd numbers, respectively, of the scan electrodes belonging to the first group, and the third and fourth subgroups may include scan electrodes placed at the even numbers and scan electrodes placed at the odd numbers, respectively, of the scan electrodes belonging to the second group.

Figure 13:
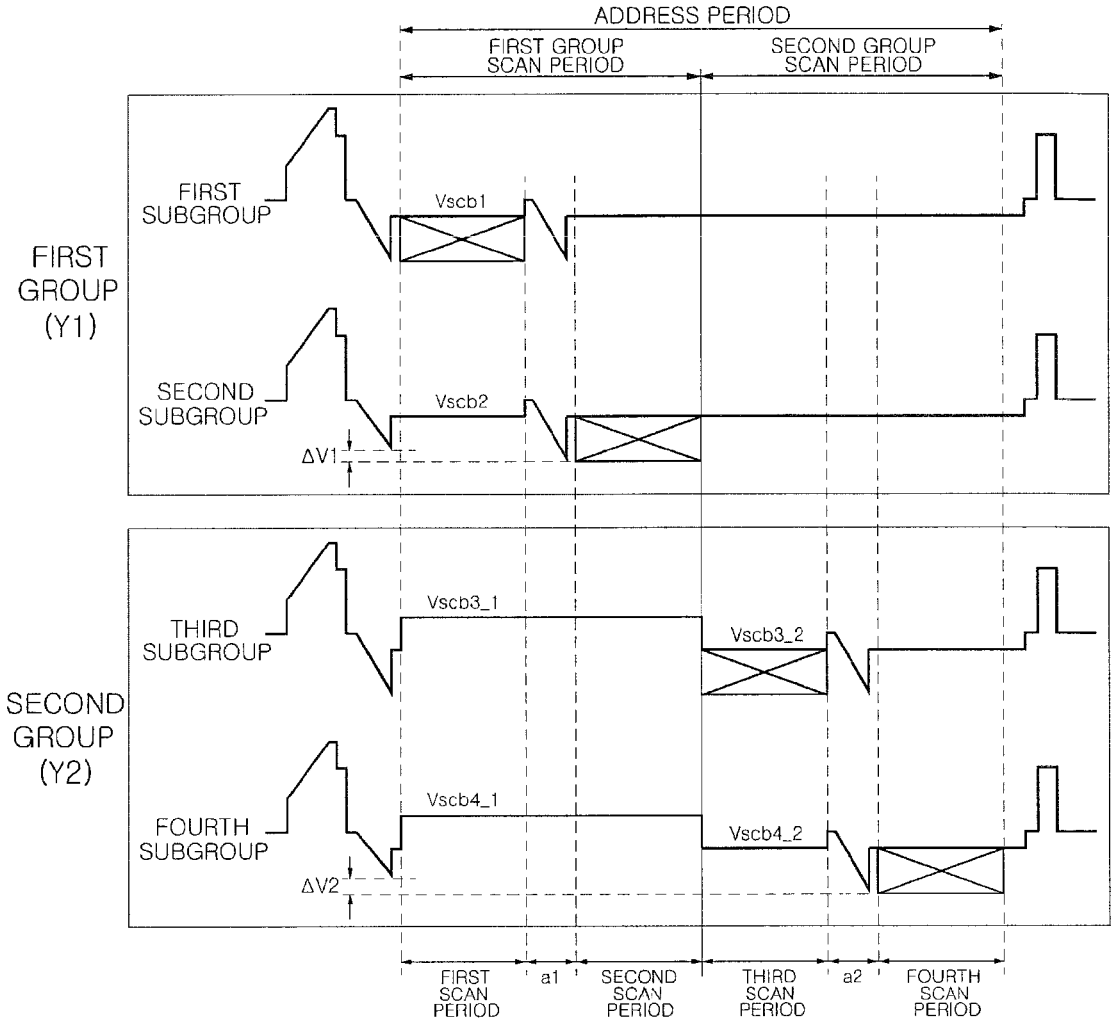

Referring to FIG. 13, during a first group scan period, scan bias voltages Vscb1 and Vscb2 supplied to the first group scan electrodes may differ from scan bias voltages Vscb3_1 and Vscb4_1 supplied to the second group scan electrodes. In addition, in order to reduce the loss of wall charges in the second group scan electrodes, which occurs during the first group scan period, the scan bias voltages Vscb3_1 and Vscb4_1 supplied to the second group scan electrodes may be higher than the scan bias voltages Vscb1 and Vscb2 supplied to the first group scan electrodes during the first scan period.

Moreover, to reduce the loss of wall charges formed in the scan electrode effectively, the amount of the scan bias voltage may be increased in order of Vscb1, Vscb2, Vscb3_1, and Vscb4_1.

However, when taking the ease of the construction and control of the driving circuit into consideration, the amounts of Vscb1, Vscb2, Vscb3_2, and Vscb4_2 may be identical and the amounts of Vscb3_1 and Vscb4_1 may be identical.

The scan bias voltages Vscb3_1 and Vscb4_1, which are high as described above, may be lower than the sustain voltage Vs. If the scan bias voltages Vscb3_1 and Vscb4_1 are lower than the sustain voltage Vs, an increase of unnecessary power consumption can be prevented and spot erroneous discharge, which occurs when the amount of wall charges formed in the scan electrodes is too many, can be reduced.

As shown in FIG. 13, signals that gradually fall may be supplied to the first and second subgroup scan electrodes during a first intermediate period "a1" between the first and second scan periods, and signals that gradually fall may be supplied to the third and fourth subgroup scan electrodes during a second intermediate period "a2" between the third and fourth scan periods. At this time, in order to compensate for the loss of wall charges formed in the scan electrodes, the lowest voltage of a setdown signal supplied to the second subgroup scan electrodes may be higher than the lowest voltage of a setdown signal supplied to the first subgroup scan electrodes during the reset period, and the lowest voltage of a setdown signal supplied to the fourth subgroup scan electrodes may be higher than the lowest voltage of a setdown signal supplied to the third subgroup scan electrodes during the reset period.

When considering the ease of the construction and control of the driving circuit, the lowest voltages of the signals supplied during the first and second intermediate periods "a1" and "a2" may be identical to the lowest voltages of the setdown signal supplied to the first and third subgroups during the reset period. Accordingly, a difference between the lowest voltage of the setdown signal supplied to the second subgroup during the reset period and the lowest voltage of the signal supplied to the second subgroup during the first intermediate period "a1" may be ΔV1, and a difference between the lowest voltage of the setdown signal supplied to the fourth subgroup during the reset period and the lowest voltage of the signal supplied to the fourth subgroup during the second intermediate period "a2" may be ΔV2.

In addition, in order to compensate for the loss of wall charges formed in the scan electrode more effectively, the difference ΔV2 may be greater than the difference ΔV1.

Unlike FIG. 13, the signal supplied to the first subgroup during the first intermediate period "a1" or the signal supplied to the third subgroup during the second intermediate period "a2" may be omitted. Further, a signal that gradually drops may be supplied to at least one of the third and fourth subgroups during the first intermediate period "a1" or a signal that gradually drops may be supplied to at least one of the first and second subgroups during the second intermediate period "a2".

The first group may include scan electrodes placed at the even numbers, of a plurality of scan electrodes formed in a panel, and the second group include scan electrodes placed at the odd numbers, of the plurality of scan electrodes formed in the panel. Further, the first and second subgroups may include scan electrodes disposed on an upper side and scan electrodes disposed on a lower upper side, respectively, of the scan electrodes belonging to the first group, and the third and fourth subgroups may include scan electrodes disposed on an upper side and scan electrodes disposed on a lower side, respectively, of the scan electrodes belonging to the second group.

Figure 14:
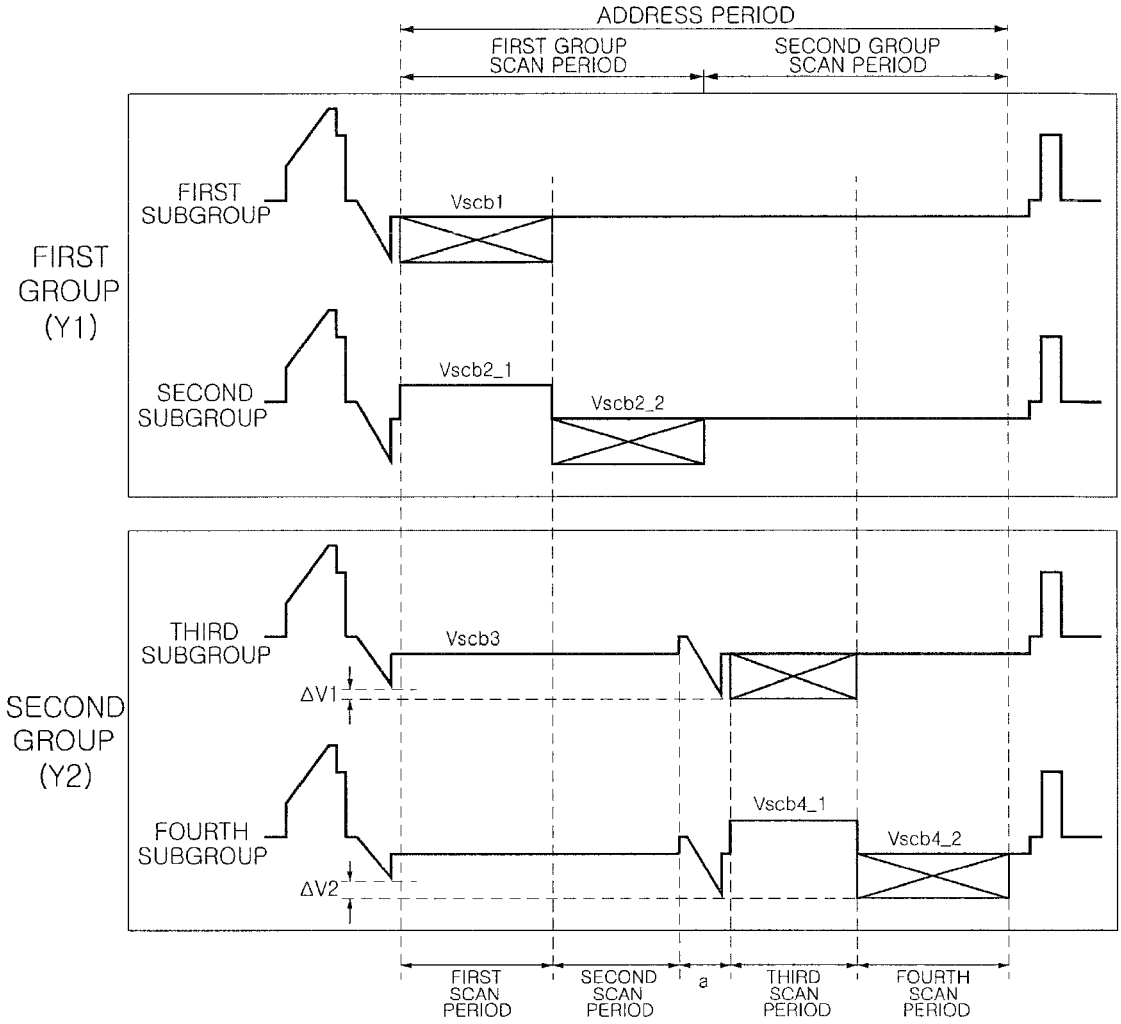

Referring to FIG. 14, signals that gradually fall may be supplied to second group scan electrodes Y2 during an intermediate period "a" between the first and second group scan periods and the third and fourth group scan periods. At this time, in order to compensate for the loss of wall charges formed in the scan electrodes, the lowest voltage of a setdown signal supplied to the second group scan electrodes Y2 during the reset period may be higher than the lowest voltage of a signal supplied to the second group scan electrodes Y2 during the intermediate period "a".

When considering the ease of the construction and control of the driving circuit, the lowest voltage of the signal supplied to the second group scan electrodes Y2 during the intermediate period "a" may be identical to the lowest voltage of the setdown signal supplied to the first group scan electrodes Y1 during the reset period. Accordingly, a difference between the lowest voltage of the setdown signal supplied to the third subgroup during the reset period and the lowest voltage of the signal supplied to the third subgroup during the intermediate period "a" may be ΔV1, and a difference between the lowest voltage of the setdown signal supplied to the fourth subgroup during the reset period and the lowest voltage of the signal supplied to the fourth subgroup during the intermediate period "a" may be ΔV2.

In addition, in order to compensated for the loss of wall charges formed in the scan electrode more effectively, the difference ΔV2 may be greater than the difference ΔV1.

As shown in FIG. 14, during the first scan period, a scan bias voltage Vscb1 supplied to the first subgroup scan electrodes may differ from a scan bias voltage Vscb2_1 supplied to the second subgroup scan electrodes. Furthermore, in order to reduce the loss of wall charges formed in the second subgroup scan electrodes, which occurs during the first scan period, the scan bias voltage Vscb2_1 supplied to the second subgroup scan electrodes may be greater than the scan bias voltage Vscb1 supplied to the first subgroup scan electrodes during the first scan period.

Further, during the third scan period, a scan bias voltage Vscb3 supplied to the third subgroup scan electrodes may differ from a scan bias voltage Vscb4_1 supplied to the fourth subgroup scan electrodes. In addition, in order to reduce the loss of wall charges formed in the fourth subgroup scan electrodes, which is generated during the third scan period, during the third scan period, the scan bias voltage Vscb4_1 supplied to the fourth subgroup scan electrodes may be higher than the scan bias voltage Vscb3 supplied to the third subgroup scan electrodes.

In order to reduce the loss of wall charges formed in the scan electrode effectively, the scan bias voltage Vscb4_1 may be greater than the scan bias voltage Vscb2_1.

When considering the ease of the construction and control of the driving circuit, the amounts of the scan bias voltages Vscb1, Vscb2_2, Vscb3, and Vscb4_2 may be identical and the amounts of the scan bias voltages Vscb2_1 and Vscb4_1 may be identical.

The scan bias voltages Vscb2_1 and Vscb4_1, which are high as described above, may be lower than the sustain voltage Vs. If the scan bias voltages Vscb2_1 and Vscb4_1 are lower than the sustain voltage Vs, an increase of unnecessary power consumption can be prevented and spot erroneous discharge, which occurs when the amount of wall charges formed in the scan electrodes is too many, can be reduced.

Unlike FIG. 14, a scan bias voltage having the same amount as that of the scan bias voltage Vscb4_1 may be applied to the fourth subgroup scan electrodes during the first and second scan periods, and a signal that gradually drops may also be applied to the first group scan electrodes Y1 during the intermediate period "a".

The first group may include scan electrodes disposed on an upper side on the basis of the center of a panel, of a plurality of scan electrodes, and the second group may include scan electrodes disposed on a lower side on the basis of the center of the panel, of the plurality of scan electrodes.

Further, the first and second subgroups may include scan electrodes placed at the even numbers and scan electrodes placed at the odd numbers, respectively, of the scan electrodes belonging to the first group. The third and fourth subgroups may include scan electrodes placed at the even numbers and scan electrodes placed at the odd numbers, respectively, of the scan electrodes belonging to the second group.

Figure 15:
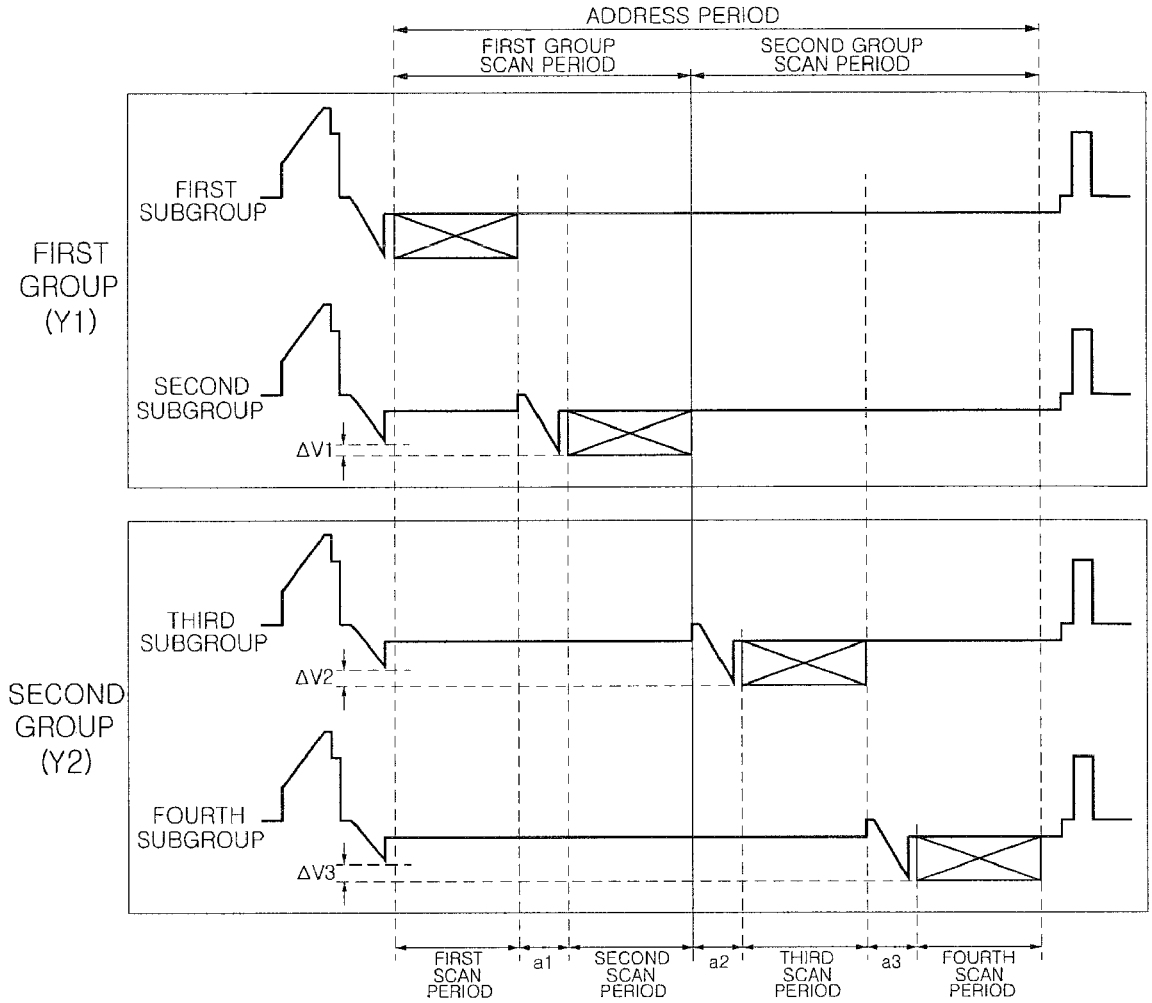

Referring to FIG. 15, a signal that gradually drops may be supplied to the second subgroup scan electrodes during a first intermediate period "a1" between first and second subgroup scan periods, a signal that gradually drops may be supplied to the third subgroup scan electrodes during a second intermediate period "a2" between the second and third subgroup scan periods, and a signal that gradually drops may be supplied to the fourth subgroup scan electrodes during a third intermediate period "a3" between the third and fourth subgroup scan periods.

At this time, in order to compensate for the loss of wall charges formed in the scan electrodes, the lowest voltage of a setdown signal supplied to the second, third, and fourth subgroup scan electrodes during the reset period may be higher than the lowest voltage of a signal supplied to the second, third, and fourth subgroup scan electrodes during the intermediate periods "a1", "a2", and "a3".

When taking the ease of the construction and control of the driving circuit into consideration, the lowest voltage of the signal supplied to the second, third, and fourth subgroup scan electrodes during the intermediate periods "a1", "a2", and "a3" may be identical to the lowest voltage of the setdown signal supplied to the first subgroup scan electrodes during the reset period. Accordingly, a difference between the lowest voltage of the setdown signal supplied to the second subgroup during the reset period and the lowest voltage of the signal supplied to the second subgroup during the first intermediate period "a1" may be $\Delta V1$, a difference between the lowest voltage of the setdown signal supplied to the second subgroup during the reset period and the lowest voltage of the signal supplied to the second subgroup during the second intermediate period "a2" may be $\Delta V2$, and a difference between the lowest voltage of the setdown signal supplied to the fourth subgroup during the reset period and the lowest voltage of the signal supplied to the fourth subgroup during the third intermediate period "a3" may be $\Delta V3$.

In addition, in order to compensate for the loss of wall charges formed in the scan electrode more effectively, the difference between the lowest voltages may be increased in order of $\Delta V1$, $\Delta V2$, and $\Delta V3$.

Unlike FIG. 15, for the ease of the construction and control of the driving circuit into consideration, a signal that gradually drops may be applied to the entire scan electrodes Y1 in each of the first, second, and third intermediate periods "a1", "a2", and "a3".

The first group may include scan electrodes disposed on an upper side on the basis of the center of a panel, of a plurality of scan electrodes, and the second group may include scan electrodes disposed on a lower side on the basis of the center of the panel, of the plurality of scan electrodes.

Further, the first and second subgroups may include scan electrodes disposed on an upper side and scan electrodes disposed on a lower side, respectively, of the scan electrodes belonging to the first group, and the third and fourth subgroups may include scan electrodes disposed on an upper side and scan electrodes disposed on a lower side, respectively, of the scan electrodes belonging to the second group.

The driving waveforms as described with reference to FIGS. 10 and 11 may be applied to some of a plurality of subfields constituting one frame. For example, the driving waveforms may be applied to at least one of subfields posterior to a second subfield.

Moreover, the driving signal waveforms as shown in FIGS. 12 to 15 may be applied at the same time in any one of the plurality of subfields, and may also be applied along with the driving signal waveforms as shown in FIGS. 6 to 11, if needed. For example, the setdown signals of the reset period shown in FIGS. 12 to 15 may include a discontinuous falling period and the lowest voltage of the setdown signal may be higher than the lowest voltage of the scan signal.

As described above with reference to FIGS. 5 to 15, in the event that the plurality of scan electrodes formed in the panel are divided into the plurality of groups or subgroups and then supplied with the scan signals sequentially, wall charges of a positive polarity (+) formed in the scan electrodes may be lost due to address discharge before the sustain period and, therefore, sustain erroneous discharge may be generated.

For example, referring to FIG. 6, wall charges of a positive polarity (+) formed in the first group scan electrode Y1 during the first group scan period may be lost during the second group scan period. Therefore, although the sustain signal is supplied during the sustain period, sustain discharge may not be generated in the first group scan electrode Y1 of a cell that should be turned on.

The luminance of a display image may be lowered or the picture quality of an image may be degraded due to the above sustain erroneous discharge. Further, when the sustain erroneous discharge occurs in subfields having a high weight (that is, subfields having a large number of sustain signals supplied therein), the problem of a reduction in the luminance or the picture quality may become more severe.

Embodiments of driving signal waveforms according to the present invention are described below with reference to FIGS. 16A to 19.

Figure 16A:
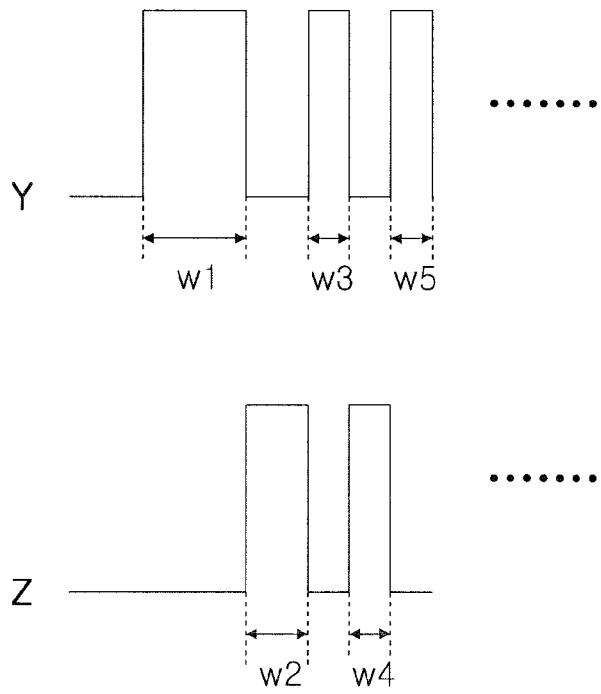
FIGS. 16A to 19 are timing diagrams illustrating embodiments of driving signal waveforms according to the present invention.

FIG. 16A shows a plurality of sustain signals alternately supplied to the scan electrode Y and the sustain electrode Z in the sustain period.

Referring to FIG. 16A, the width of each of the plurality of sustain signals may have a value greater than 2. For example, a width w1 of a first sustain signal supplied to the scan electrode may be greater than a width w2 of a second sustain signal supplied to the sustain electrode, and the width w2 of the second sustain signal may be greater than a width w3 of a third sustain signal supplied to the scan electrode.

If the width w1 or w2 of the first or second sustain signal is greater than the widths w3, w4, and w5 of the remaining sustain signal as shown in FIG. 16A, first and second sustain discharges can be performed stably although wall charges of a positive polarity (+) formed in the scan electrodes Y1 are lost anterior to the sustain period. In addition, if the first and second sustain discharges are performed stably as described above, the wall charge state of the scan and sustain electrodes can be stabilized and subsequent sustain discharges can also be performed stably.

In FIG. 16A, it is shown that the width w1 or w2 of the first or second sustain signal is greater than the widths w3, w4, and w5 of the remaining sustain signals. However, the width of the sustain signal may be decreased gradually, such as that the width w3 of the third sustain signal is set greater than the width w4 of the fourth sustain signal.

Figure 16B:
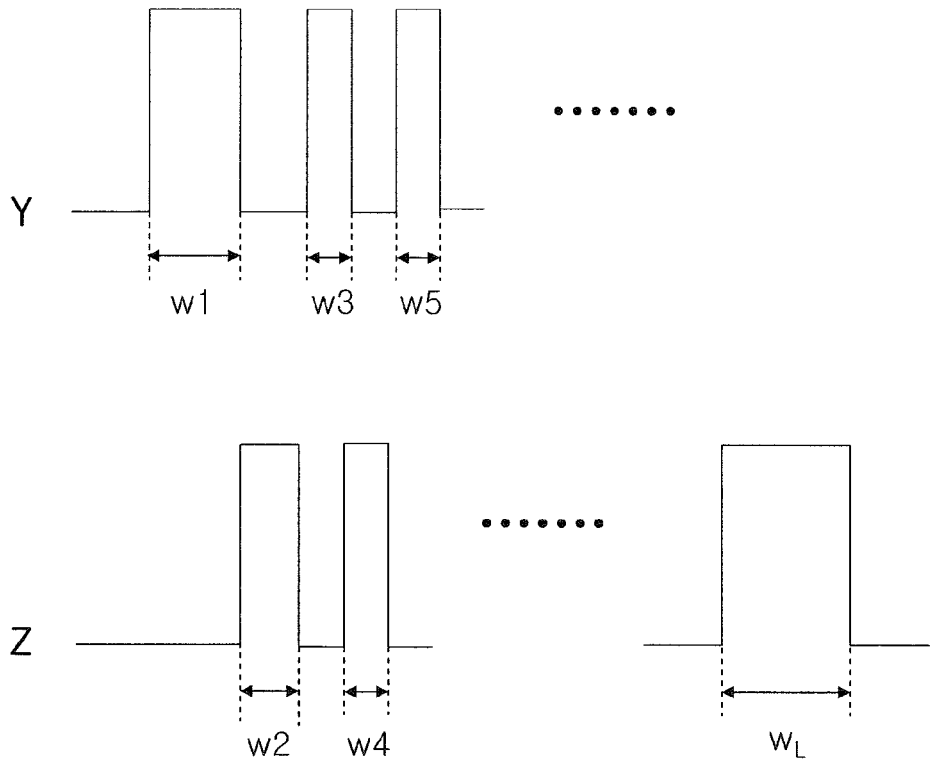

Referring to FIG. 16B, a width $w_L$ of a last sustain signal supplied to the scan and sustain electrodes may be greater than a width w1 of the first sustain signal.

Figure 16C:
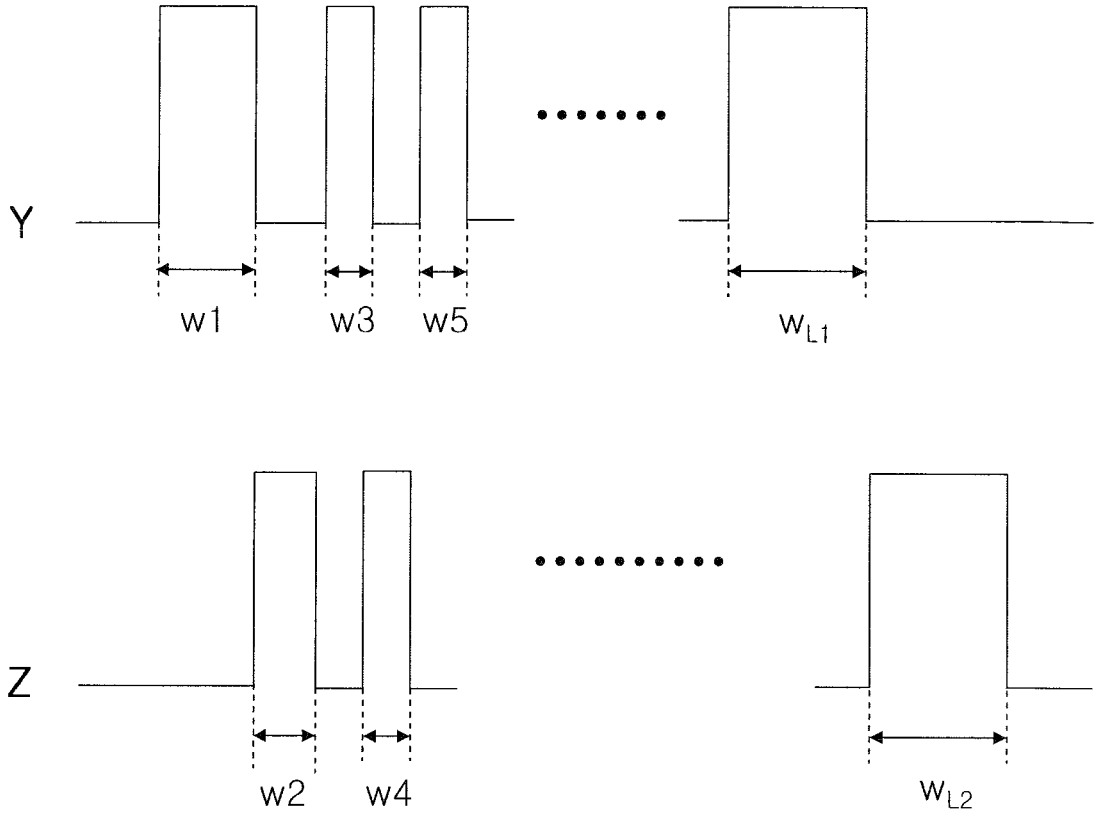

Referring to FIG. 16C, a width $w_{L1}$, $w_{L2}$ of each of two or more last sustain signals supplied to the scan and sustain electrodes may be greater than a width w1 of the first sustain signal.

Figure 17:
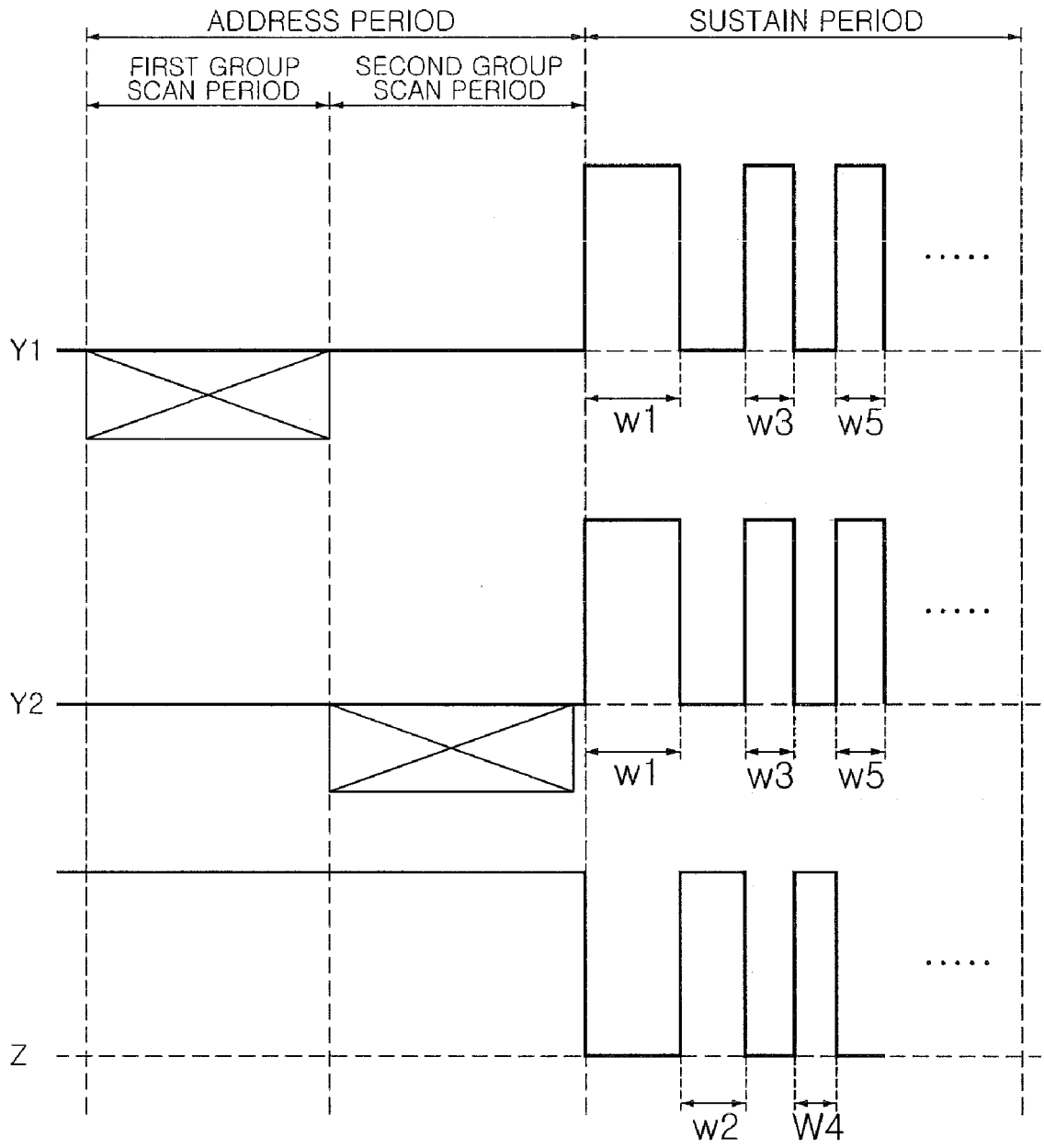

Referring to FIG. 17, in the case where the plurality of scan electrodes formed in the panel are divided into two or more groups and then driven, wall charges formed in a first group scan electrode Y1 during a first group scan period may be lost during a second group scan period, so sustain erroneous discharge can be generated in the sustain period.

In order to prevent this problem, a width w1 of a first sustain signal of a plurality of sustain signals during the sustain period may be set greater than widths w2, w3, w4, and w5 of the remaining sustain signals, so a first sustain discharge can be generated can be generated stably.

In addition, the width w2 of the second sustain signal may be set greater than the widths w3, w4, and w5 of the remaining sustain pulses. Accordingly, a second sustain discharge can be generated stably.

If the first or second sustain discharge is generated stably as described above, wall charges of the scan electrode Y and the sustain electrode Z can be maintained to a state which is sufficient for a sustain discharge. Accordingly, subsequent sustain discharges can also be generated stably.

The sustain signals as described with reference to FIGS. 16A, 16B, 16C and 17 may be applied to some of a plurality of subfields constituting one frame.

In the case where the width of a first sustain signal is increased, a first sustain discharge may be generated in off cells (that is, discharge cells where address discharge has not occurred), so sustain discharge may be generated by the remaining sustain signals. For this reason, the widths of first to third sustain signals may be increased in subfields having a small weight (that is, subfields having a small number of sustain signals supplied therein).

If the widths of the first to third sustain signals are set to be large in subfields having a small weight as described above, the luminance of the entire image may not be significantly influenced although sustain discharge is generated in off cells.

In addition, in order not to significantly lower the luminance of a display image, the widths of the first to third sustain signals in subfields, which are half or less of the entire subfields constituting one frame, may be increased.

In the case where subfields are arranged in order of increasing weights, the widths of the first to third sustain signals in the first to fourth subfields may be larger than the widths of the remaining sustain signals.

Figure 18:
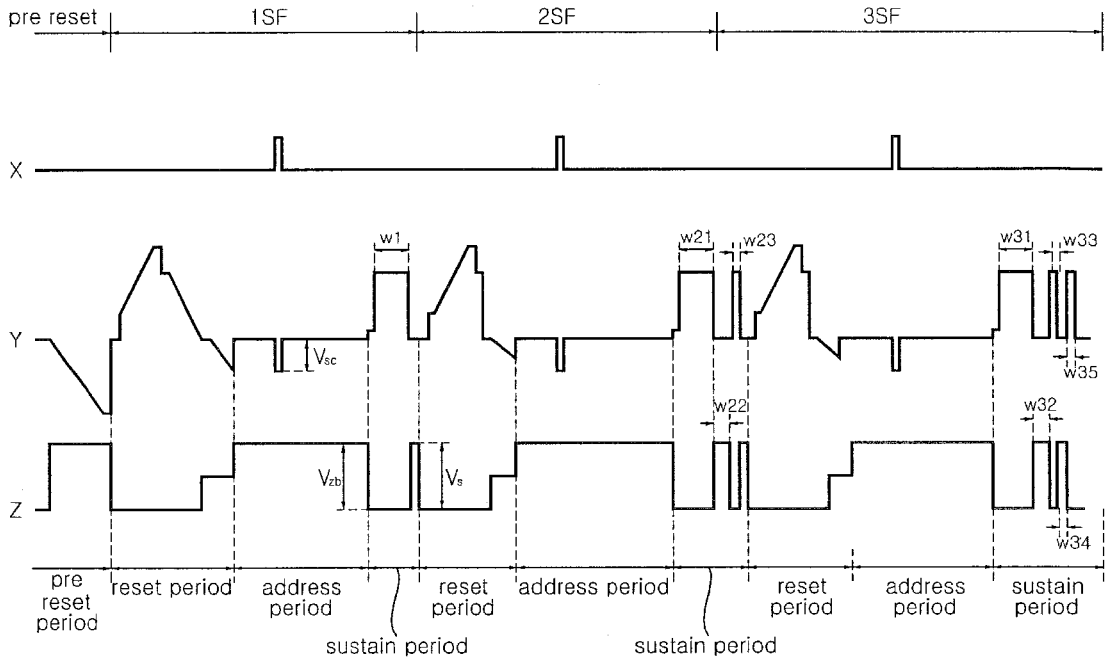

Referring to FIG. 18, in first to third subfields 1SF, 2SF and 3SF of a plurality of subfields constituting one frame, widths w1, w21, and w31 of first sustain signals may be set larger than widths w22, w23, w32, w33, w34, and w35 of the remaining sustain signals, and the widths w22 and w32 of the second sustain signals may be set larger than the widths w23, w33, w34, and w35 of the remaining sustain signals in order to generate sustain discharge stably.

It has been described with reference to FIG. 18 that the widths of the first to second sustain signals in three of the plurality of subfields are increased. However, the widths of the first and second sustain signals in four or more subfields may be increased considering driving margin of a panel, etc., and the widths of the sustain signals following the third sustain signal may also be varied.

Figure 19:
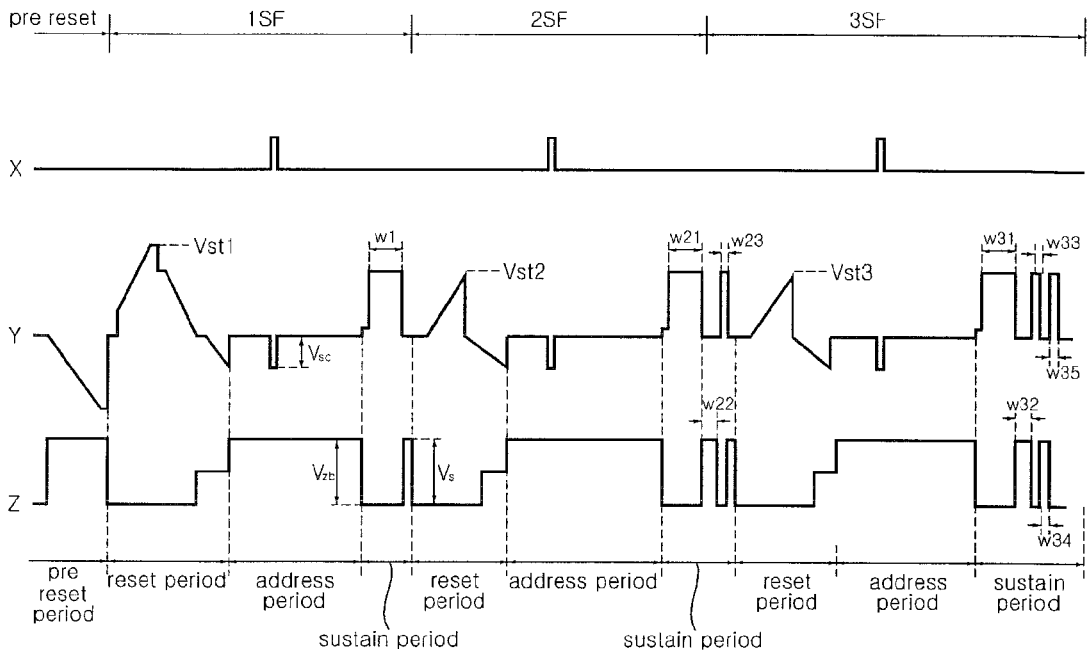

As shown in FIG. 19, in a first subfield 1SF, a reset signal that rises up to Vst1 may be supplied so as to perform reset discharge on the entire discharge cells, and in subfields 2SF, 3SF, . . . , following a second subfield, a reset signal that rises up to Vst2 or Vst3 lower than Vst1 may be supplied in order to perform reset discharge only on discharge cells in which sustain discharge has occurred in previous subfields.

If the reset signal having the highest voltages Vst2 and Vst3 lower than Vst1 are supplied in the subfields 2SF, 3SF, . . . , following the second subfield as described above, consumption power for panel driving can be reduced and sufficient panel driving margin can be secured. Accordingly, an increase of driving power and the length of the address period, which may occur in the method of dividing and driving the scan electrodes according to the present invention, can be compensated for.

In addition, as the temperature of a plasma display apparatus rises, a possibility that sustain erroneous discharge can occur may be decreased. Thus, in order to secure panel driving margin, the width of the first sustain signal may be set in reverse proportion to the temperature of the plasma display apparatus.

The following Table 1 lists the result where the luminance of a display image was measured while varying the width of the first sustain signal, and illustrates the luminance measurement result of full white picture data and full black picture data. In this measurement, the width w2 of the sustain signal subsequent to the second sustain signal was set to 4 μm and the width w1 of the first sustain signal was varied in the range of 4 μm to 38 μm.

TABLE 1

| First sustain signal width (w1) | Second sustain signal width (w2) | Luminance 1 (Full white) | Luminance 2 (Full black) |
|---|---|---|---|
| 4 μm | 4 μm | 0.62 | 0 |
| 6 μm | 4 μm | 0.64 | 0 |
| 8 μm | 4 μm | 0.7 | 0 |
| 10 μm | 4 μm | 0.76 | 0 |
| 12 μm | 4 μm | 0.86 | 0.01 |
| 14 μm | 4 μm | 0.87 | 0.01 |
| 16 μm | 4 μm | 0.9 | 0.02 |
| 18 μm | 4 μm | 0.92 | 0.04 |
| 20 μm | 4 μm | 0.93 | 0.05 |
| 22 μm | 4 μm | 0.93 | 0.05 |
| 24 μm | 4 μm | 0.95 | 0.06 |
| 26 μm | 4 μm | 0.97 | 0.08 |
| 28 μm | 4 μm | 0.97 | 0.09 |
| 30 μm | 4 μm | 0.98 | 0.11 |
| 32 μm | 4 μm | 1 | 0.14 |
| 34 μm | 4 μm | 1 | 0.19 |
| 36 μm | 4 μm | 1 | 0.23 |
| 38 μm | 4 μm | 1 | 0.26 |

The luminance values in Table 1 indicate the luminances of respective display images assuming that the luminance of full white picture is set to 1 and the luminance of full black picture is set to 0.

Figure 20:
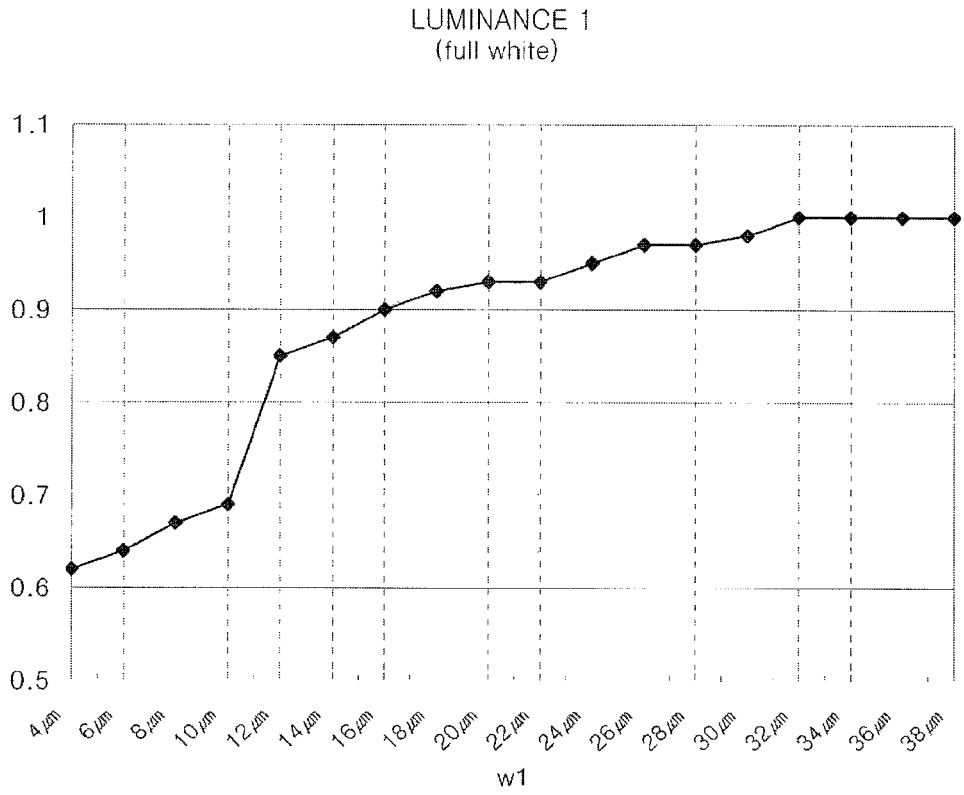
FIGS. 20 and 21 are graphs illustrating the result where luminance of a display image was measured according to variation of a width of a first sustain signal.

Referring to Table 1 and FIG. 20, in luminance 1, luminance is close to the full white picture when the width w1 of the first sustain signal is 32 μm to 38 μm, and the luminance of a display image is reduced as the width w1 of the first sustain signal is reduced.

In addition, when the width w1 of the first sustain signal is 12 g/m or less, luminance 1 abruptly decreases, and when the width w1 of the first sustain signal is 10 μm or less, luminance 1 is reduced to less than 0.8.

Figure 21:
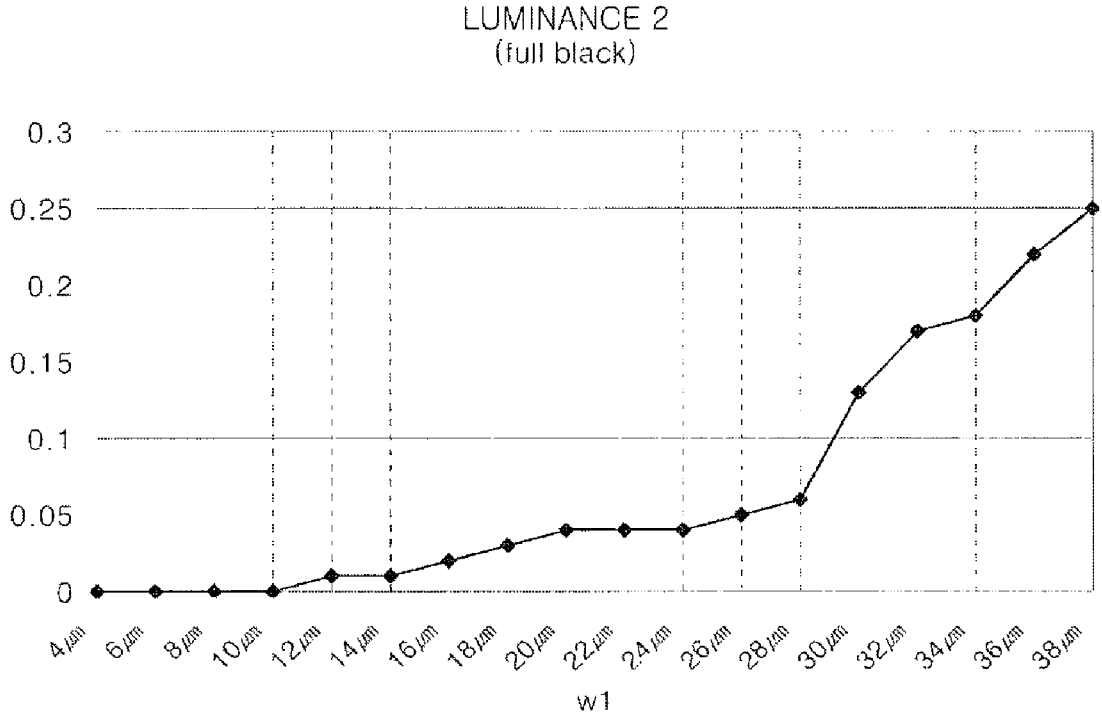

Referring to Table 1 and FIG. 21, in luminance 2, when the width w1 of the first sustain signal is 4 μm to 10 μm, a luminance is close to the full black picture, and as the width w1 of the first sustain signal is increased, the luminance of a display image is increased.

Further, if the width w1 of the first sustain signal is increased to 30 μm or more, luminance 2 abruptly increases, and when the width w1 of the first sustain signal is 32 μm or more, luminance 2 exceeds 1.1.

Accordingly, in order not to greatly distort the luminance of a display image by reducing sustain erroneous discharge, the width w1 of the first sustain signal may be set to 3 to 7.5 times the width w2 of the second sustain signal.

In addition, the width w2 of the second sustain signal may be larger than the widths w3, w4, w5, . . . , of the sustain signals following the third sustain signal. In order to secure sufficient driving margin of a panel while preventing sustain erroneous discharge, the width w2 of the second sustain signal may be set to 1.3 to 3.5 times the width w3, w4, w5, . . . , of the sustain signals following the third sustain signal.

The present invention may also be implemented in computer-recordable media using codes that can be read by the computer. The computer-recordable media may include all kinds of recording media in which data that can be read by a computer system are stored. Examples of the computer-readable recording media may include ROM, RAM, CD-ROM, magnetic tapes, floppy disks, optical data storage device, and so on. The examples of the computer-readable recording media may also include a carrier wave (for example, transmission over the Internet). Furthermore, the computer-readable recording media may be distributed in computer systems connected over a network, and codes that can be read by computers may be stored and executed in the distributed recording media in a distributed manner. In addition, functional programs, codes, and code segments for implementing the present invention can be easily inferred by programmers having ordinary skill in the art of the present invention.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display apparatus, comprising:

a plasma display panel including a plurality of scan electrodes and sustain electrodes formed on an upper substrate, and a plurality of address electrodes formed on a lower substrate; and a driver for supplying driving signals to the plurality of electrodes, wherein the plurality of scan electrodes are divided into first and second groups and then supplied with scan signals, and scan bias voltages supplied to the first and second groups in at least any one period of an address period are different from each other, in at least one of a plurality of subfields constituting one frame, a width of a first sustain signal of a plurality of sustain signals supplied during a sustain period is larger than a width of second, third, and fourth sustain signals of the plurality of sustain signals, and the first and third sustain signals being supplied to the scan electrodes, and the second and fourth sustain signals being supplied to the sustain electrodes, wherein the width of the third sustain signal of the plurality of sustain signals is larger than the width of the fourth sustain signal of the plurality of sustain signals.

2. The plasma display apparatus of claim 1, wherein the width of the first sustain signal is 3 to 7.5 times the width of the second sustain signal.

3. The plasma display apparatus of claim 1, wherein the width of the second sustain signal of the plurality of sustain signals is 1.3 to 3.5 times the width of the third sustain signal of the plurality of sustain signals.

4. The plasma display apparatus of claim 1, wherein in first to fourth subfields of the plurality of subfields, the width of the first sustain signal is larger than that of at least one of the remaining sustain signals.

5. The plasma display apparatus of claim 1, wherein a width of a first sustain signal supplied in each of first to fourth subfields of the plurality of subfields is larger than a width of a first sustain signal supplied in each of the remaining subfields.

6. The plasma display apparatus of claim 1, wherein widths of first sustain signals supplied in first to fourth subfields of the plurality of subfields are decreased in order of later subfield driving.

7. The plasma display apparatus of claim 1, wherein a highest voltage of a reset signal supplied in a first subfield of the plurality of subfields is higher than a highest voltage of a reset signal supplied in each of the remaining subfields.

8. The plasma display apparatus of claim 1, wherein the width of the first sustain signal is changed depending on a temperature of the plasma display apparatus.

9. The plasma display apparatus of claim 1, wherein:

the address period sequentially includes first and second group scan periods in which scan signals are supplied to the first and second groups, respectively, and in the first group scan period, the scan bias voltage supplied to the second group is higher than the scan bias voltage supplied to the first group.

10. The plasma display apparatus of claim 1, wherein:

the address period sequentially includes first and second group scan periods in which scan signals are supplied to the first and second groups, respectively, and in a period between the first and second group scan periods, a setdown signal that gradually falls is supplied to at least one of the first and second groups.

11. The plasma display apparatus of claim 10, wherein a lowest voltage of a reset signal supplied to the second group in a reset period is higher than a lowest voltage of a setdown signal supplied to the second group in the period between the first and second group scan periods.

12. The plasma display apparatus of claim 10, wherein a lowest voltage of a reset signal supplied to the first group is lower than a lowest voltage of a reset signal supplied to the second group.

13. The plasma display apparatus of claim 1, wherein a lowest voltage of a reset signal supplied to at least one of the first and second groups is higher than a scan voltage of a negative polarity.

14. The plasma display apparatus of claim 1, wherein in a reset period, a discontinuous setdown signal is supplied to at least one of the first and second groups, wherein the discontinuous setdown signal sequentially includes a first falling period in which a voltage gradually drops to a first voltage, a sustain period in which the voltage is sustained to the first voltage, and a second falling period in which the voltage gradually drops from the first voltage.

15. A method of driving a plasma display panel comprising a plurality of scan electrodes and sustain electrodes formed on an upper substrate and a plurality of address electrodes formed on a lower substrate, the method comprising the step of:

dividing the plurality of scan electrodes into first and second groups, wherein an address period includes first and second group scan periods in which scan signals are supplied to the first and second groups, in the first group scan period, a scan bias voltage supplied to the second group is higher than a scan bias voltage supplied to the first group supplied, in at least one of a plurality of subfields constituting one frame, a width of a first sustain signal of a plurality of sustain signals supplied during a sustain period is larger than a width of second, third, and fourth sustain signals of the plurality of sustain signals, and the first and third sustain signals being supplied to the scan electrodes, and the second and fourth sustain signals being supplied to the sustain electrodes, wherein the width of the third sustain signal of the plurality of sustain signals is larger than the width of the fourth sustain signal of the plurality of sustain signals.

16. The method of claim 15, wherein the width of the first sustain signal is 3 to 7.5 times the width of the second sustain signal.

17. The method of claim 15, wherein the width of the second sustain signal of the plurality of sustain signals is 1.3 to 3.5 times the width of the third sustain signal of the plurality of sustain signals.

18. The method of claim 15, wherein in first to fourth subfields of the plurality of subfields, the width of the first sustain signal is larger than that of each of the remaining sustain signals.

* * * * *